US010515756B2

(12) United States Patent
Waeckerle et al.

(10) Patent No.: US 10,515,756 B2
(45) Date of Patent: Dec. 24, 2019

(54) BASIC MODULE FOR MAGNETIC CORE OF AN ELECTRICAL TRANSFORMER, MAGNETIC CORE COMPRISING SAID BASIC MODULE, METHOD FOR MANUFACTURING SAID MAGNETIC CORE, AND TRANSFORMER COMPRISING SAID MAGNETIC CORE

(71) Applicant: APERAM, Luxembourg (LU)

(72) Inventors: Thierry Waeckerle, Nevers (FR); Alain Demier, Varennes-Vauzelles (FR)

(73) Assignee: APERAM, Luxembourg (LU)

( * ) Notice: Subject to any disclaimer, the term of this patent is extended or adjusted under 35 U.S.C. 154(b) by 287 days.

(21) Appl. No.: 15/529,339

(22) PCT Filed: Nov. 25, 2014

(86) PCT No.: PCT/IB2014/066322
§ 371 (c)(1),
(2) Date: Aug. 17, 2017

(87) PCT Pub. No.: WO2016/083866
PCT Pub. Date: Jun. 2, 2016

(65) Prior Publication Data
US 2017/0345554 A1 Nov. 30, 2017

(51) Int. Cl.
*H01F 27/28* (2006.01)
*H01F 27/25* (2006.01)
(Continued)

(52) U.S. Cl.
CPC ..... *H01F 27/2847* (2013.01); *H01F 27/25* (2013.01); *H01F 27/26* (2013.01);
(Continued)

(58) Field of Classification Search
CPC ..... H01F 27/02; H01F 27/06; H01F 27/25; H01F 27/26; H01F 27/33; H01F 27/2847;
(Continued)

(56) References Cited

U.S. PATENT DOCUMENTS 3,686,561 A * 8/1972 Spreadbury ..... G05F 3/06 323/308
3,843,424 A 10/1974 Thornburg et al.
(Continued)

FOREIGN PATENT DOCUMENTS

DE 1813643 A1 6/1970
EP 1 742 232 A2 1/2007
(Continued)

OTHER PUBLICATIONS

International Search Report, dated Aug. 17, 2015, from corresponding PCT application.
(Continued)

*Primary Examiner* — Adolf D Berhane
(74) *Attorney, Agent, or Firm* — Young & Thompson

(57) ABSTRACT

Disclosed is a basic module of a magnetic core of a wound electrical transformer. The basic module includes first and second windings placed atop one another and made of first and second materials, respectively. The first material is a crystal having a saturation magnetization≥1.5 T and magnetic losses less than 20 W/kg in sine waves having a frequency of 400 Hz, for maximum induction of 1 T, and the second material is a material having an apparent saturation magnetostriction less than or equal to 5 ppm and magnetic losses less than 20 W/kg in sine waves having a frequency of 400 Hz, for maximum induction of 1 T. The cross-sections of the first winding and cross-sections of the second winding satisfy ($S_1/(S_1+S_3)$; $S_2/(S_2+S_4)$) of the first material, having
(Continued)

Figure 1:
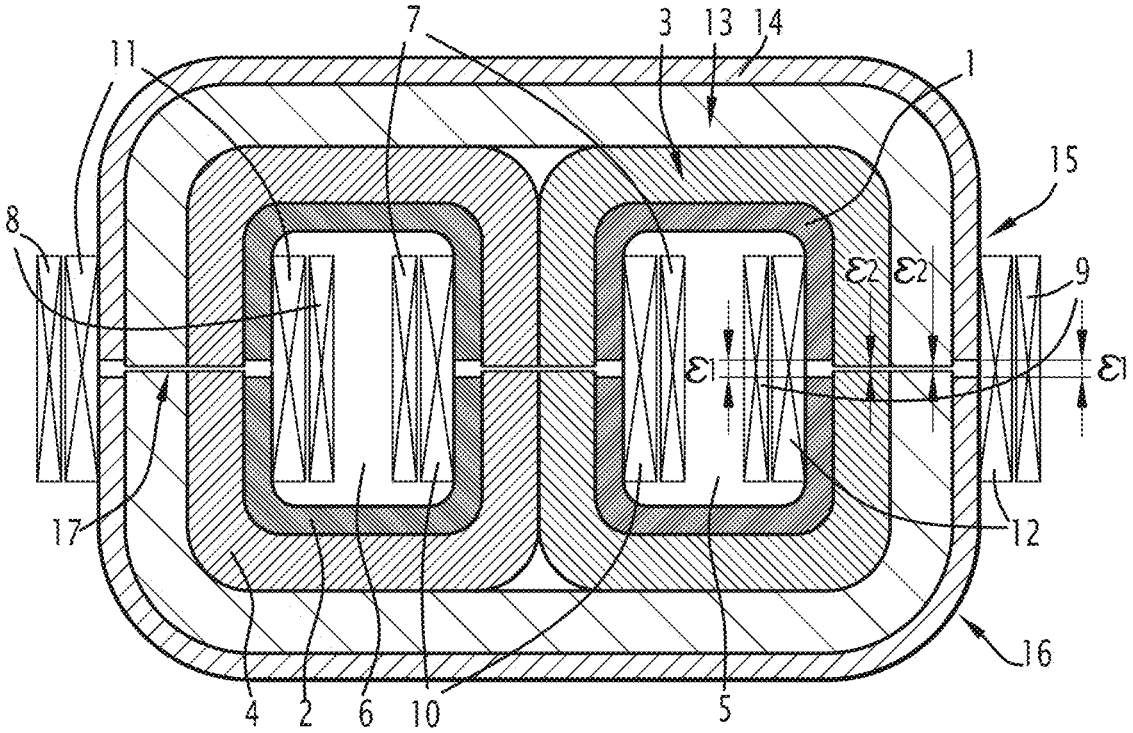

a high saturation magnetization, compared to the cross-section of both materials together, is 2%-50%.

30 Claims, 2 Drawing Sheets

(51) Int. Cl.
*H01F 27/26* (2006.01)
*H01F 27/33* (2006.01)
*H01F 41/02* (2006.01)
*H01F 3/14* (2006.01)
*H01F 3/10* (2006.01)

(52) U.S. Cl.
CPC ..... *H01F 27/33* (2013.01); *H01F 41/0213* (2013.01); *H01F 3/14* (2013.01); *H01F 41/0226* (2013.01); *H01F 2003/106* (2013.01)

(58) Field of Classification Search
CPC .. H01F 3/14; H01F 41/0226; H01F 2003/106; H01F 27/28
See application file for complete search history.

(56) References Cited

U.S. PATENT DOCUMENTS 3,881,967 A 5/1975 Cochardt et al.
4,520,335 A * 5/1985 Rauch ..... H01F 27/245 336/212
4,615,106 A * 10/1986 Grimes ..... H01F 41/0226 29/605
5,105,097 A * 4/1992 Rothe ..... H03K 17/80 307/108
5,160,379 A 11/1992 Yoshizawa et al.
2005/0088267 A1 * 4/2005 Watts ..... G05F 7/00 336/178
2006/0077030 A1 4/2006 Herzer et al.
2014/0239892 A1 8/2014 Sawa et al.

FOREIGN PATENT DOCUMENTS

JP S55-88313 A 7/1980
JP H03-268311 A 11/1991
JP H03-271346 A 12/1991
JP H04-74403 A 3/1992
JP 05-101943 A 4/1993
JP 07-153613 A 6/1995
JP H08-250337 A 9/1996
JP 2010-087536 A 4/2010
JP 2013-020995 A 1/2013
JP 2013-243370 12/2013
RU 2496206 10/2013
RU 2517300 5/2014
WO 2011-107387 A1 9/2011
WO 2013/069270 5/2013

OTHER PUBLICATIONS

Japanese Office Action issued in Application No. 2017-527912, dated Sep. 25, 2018 with English Abstract.

* cited by examiner

BASIC MODULE FOR MAGNETIC CORE OF AN ELECTRICAL TRANSFORMER, MAGNETIC CORE COMPRISING SAID BASIC MODULE, METHOD FOR MANUFACTURING SAID MAGNETIC CORE, AND TRANSFORMER COMPRISING SAID MAGNETIC CORE

The invention relates to the field of electrical transformers able to be placed on board aircraft. They serve to provide galvanic isolation between the source network and the on board electrical and electronic systems, as well as the conversion of voltage between the primary circuit (side of the power supply grid by the on board generator(s)) and one or several secondary circuits. In addition, these transformers can be "rectifiers" through a downstream functionality based on electronic components, in order to deliver a constant voltage to certain on board devices.

Low-frequency (≤1 kHz) on board transformers are primarily made up of a magnetic core made from a soft, foliated magnetic alloy, stacked or wound depending on the construction constraints, and primary and secondary windings made from copper. The primary power supply currents vary over time, and are periodic but do not necessarily have a purely sinusoidal shape, which does not fundamentally change the needs of the transformer.

These transformers are subject to multiple constraints.

They must have as small as possible a volume and/or mass (in general, the two are closely linked), and therefore as high a volume or mass power density as possible. The lower the operating frequency is, the larger the cross-section of the magnetic yoke and the volume (and therefore the mass) of this yoke are, which exacerbates the interest of miniaturizing it in low-frequency applications. Since the fundamental frequency is quite often imposed, which amounts to obtaining the highest possible working magnetic flux, if the delivered electrical power is imposed, minimizing the passage section of the magnetic flux (and therefore the mass of the materials), still to increase the specific power by reducing the on board masses.

They must have a sufficient longevity (10 to 20 years minimum, depending on the applications) so as to make them profitable. As a result, the operating heat balance must be taken into account with respect to the aging of the transformer. Typically, a minimum lifetime of 100,000 h at 200° C. is desirable.

The transformer must work on a power grid with a roughly sinusoidal frequency, with an effective output voltage amplitude that may very temporarily up to 60% from one moment to the next, and in particular when the transformer is powered on or when an electromagnetic actuator is abruptly activated. As a result, and by design, this causes an inrush current at the primary of the transformer through the nonlinear magnetization curve of the magnetic core. The elements of the transformer (insulating materials and electronic components) must be able to withstand strong variations of this inrush current, called "inrush effect", without damage.

The noise emitted by the transformer due to the electromagnetic forces and magnetostriction must be low enough to comply with the standards in force or to meet the requirements of users and staff posted near the transformer. Aircraft pilots and copilots increasingly wish to be able to communicate by direct voice, and no longer using headsets.

The thermal efficiency of the transformer is also very important, since it determines both its internal operating temperature and the heat flows that must be discharged, for example using an oil bath surrounding the windings and the yoke, associated with oil pumps sized accordingly. The thermal power sources are primarily losses by Joule effect from the primary and secondary windings, and magnetic losses from the variations of the magnetic flux over time $d\phi/dt$ and in the magnetic material. In industrial practice, the volume thermal power to be extracted is limited to a certain threshold imposed by the size and power of the oil pumps, and the internal operating limit temperature of the transformer.

Lastly, the cost of the transformer must be kept as low as possible in order to ensure the best technical-economic compromise between cost of materials, design, manufacturing and upkeep, and optimization of the electric power density (mass or volume) of the device by taking the heat balance of the transformer into account.

In general, there is an interest in seeking the highest possible mass/volume power density. The criteria to be taken into account to assess this are primarily the saturation magnetization Js and the magnetic inductance at 800 A/m $B_{800}$.

Two technologies are currently used to manufacture low-frequency on board transformers.

According to a first of these techniques, the transformer includes a wound magnetic circuit when the power source is a single-phase source. When the power source is a three-phase source, the structure of the core of the transformer is made by two toroidal cores of the aforementioned type side by side, and surrounded by a third wound toroid forming an "8" around the two previous toroidal cores. In practice, this circuit form imposes a small thickness of the magnetic sheet (typically 0.1 mm). As a result, this technology is used only when the power supply frequency requires, in light of the induced currents, the use of sheets with this thickness, i.e., typically for frequencies of several hundred Hz.

According to the second of these techniques, a stacked magnetic circuit is used, irrespective of the considered magnetic sheet thicknesses. This technology is therefore valid for any frequency below several kHz. However, special care must be taken with respect to deburring at the juxtaposition, or even the high-performing electrical insulation of the sheets, in order both to reduce stray air gaps (and therefore optimize the apparent power) and limit the currents induced between sheets.

In either of these technologies, in the on board power transformers, and irrespective of the considered sheet thickness, a soft magnetic material with a high permeability is used. Two families of these materials exist with thicknesses from 0.35 mm to 0.1, or even 0.05 mm, and clearly differ by their chemical compositions:

- Fe-3% Si alloys (throughout the text, the compositions of the alloys are given in wt %, with the exception of nanocrystalline alloys, which will be discussed later), the fragility and electrical resistivity of which are primarily controlled by the Si content level; their magnetic losses are fairly low (non-grain-oriented N.O. alloys) to low (grain-oriented G.O. alloys), their saturation magnetization Js is high (around 2T), their cost is very moderate; there are two sub-families of Fe-3% Si used either for an on board transformer core technology, or for another:
  - grain-oriented (G.O.) Fe-3% Si, used for on board transformer structures of the "wound" type: their high permeability (B800=1.8–1.9 T) is related to their very pronounced texture {110}<001>; these alloys have the advantage of being inexpensive, easy to shape, and having a high permeability, but their saturation is limited to 2 T, and they have a very pronounced nonlinearity of the magnetization curves that may cause very significant harmonics;

non-grain-oriented (N.O.) Fe-3% Si, used for on board transformer structures of the "cut-stacked" type; their permeability is lower, their saturation magnetization is similar to that of G.O.;

Fe-48% Co-2% V alloys, the fragility and electrical resistivity of which are primarily controlled by the vanadium; they owe their high magnetic permeability properties to their physical characteristics (low magnetic crystalline anisotropy K1), but also to the cooling after final annealing that adjusts K1 to a very low value; due to their fragility once they stay several seconds between 400 and 700° C., these alloys must be shaped in the cold drawn state (by cutting, stamping, bending, etc.), and only once the part has its final shape (rotary machine will stator, E or I transformer profile) is the material then in annealed in the final step; furthermore, due to the presence of V, the quality of the annealing atmosphere must be perfectly controlled so as not to be oxidizing; lastly, the price of this material, which is very high (20 to 50 times that of Fe-3% Si—G.O.), is related to the presence of Co and is roughly proportional to the Co content level.

Aside from these two families of high-permeability materials (G.O. Fe-3% Si and Fe-48% Co-2% V) currently primarily used in on board low-frequency power transformers, Iron-based amorphous materials are sometimes encountered when the thermal requirement (dissipation, magnetic losses) is very high, which then requires downgrading the power density substantially (Js=1.88 T). The amorphous materials are only used in wound circuits.

It has been known for some time that adding Co to iron increases the magnetic saturation of the alloy, up to 2.4 T around 35 to 50% Co, and the use of other FeCo-based materials containing less cobalt than Fe-48% Co-2% V in on board transformers could therefore have been expected.

Unfortunately, these alloys with a lower Co content level have been shown to have a magnetocrystalline anisotropy of several tens of kJ/m$^3$, which does not allow them to have a high permeability in the case of a random distribution of the final crystallographic orientations. In the case of magnetic sheets with less than 48% Co for medium-frequency on board transformers, it has been known for some time that the likelihood of success necessarily involves an acute $_{texture}$ characterized by the fact that in each grain, an axis <100> is very close to the rolling direction. The texture {110}<100> obtained by Goss in 1946 in Fe-3% Si by secondary recrystallization is an illustrious case of this: however, the sheet had to contain no cobalt.

More recently, it has been shown in document U.S. Pat. No. 3,881,967 that with additions of 4 to 6% Co and 1 to 1.5% Si, and also using a secondary recrystallization, high permeabilities could also be obtained: B800≈1.98 T, that is a gain of 0.02 T/% Co at 800 A/m relative to the best current G.O. Fe-3% Si sheets (B10≈1.90 T). It is, however, obvious that an increase of only 4% of the B800 is not sufficient to substantially lighten a transformer. As a comparison, a Fe-48% Co-2% V alloy optimized for a transformer has a B800 of about 2.15 T±0.05 T, which allows an increase in magnetic flux to 800 A/m for a same yoke cross-section of about 13%+3%, at 2500 A/m of about 15%, at 5000 A/m of about 16%.

It also indicates the presence in G.O. Fe-3% Si of large grains due to the secondary recrystallization, and a very weak disorientation between crystals allowing a B800 of 1.9 T, coupled with the presence of a magnetostriction coefficient $\lambda_{100}$ very significantly exceeding 0. This makes this material very sensitive to mounting and operating constraints, which, in industrial practice, brings the B800 of a G.O. Fe-3% Si operating in an on board transformer back to about 1.8 T. This is also the case for the alloys of U.S. Pat. No. 3,881,967. Furthermore, Fe-48% Co-2% V has magnetostriction coefficients with an amplitude 4 to 5 times higher than Fe-3% Si, but around the distribution of the crystallographic orientations and a small mean size of the grains (several tens of microns), which makes them much less sensitive to low constraints, and therefore does not significantly decrease the B800 during operation.

During operation, it must therefore be considered that replacing a G.O. Fe 3% Si with a Fe-48% Co-2% V causes an increase in the magnetic flux with a constant section of the on board transformer of about 20 to 25% for operating field amplitudes from 800 to 5000 A/m, i.e., an increase of about 0.5% of the magnetic flux per 1% of Co. The alloy of U.S. Pat. No. 3,881,967 allows a 1% increase of the magnetic flux per 1% of Co, but as previously stated, this total increase (4%) was deemed too low to justify the development of this material.

It has also been proposed, in particular in document U.S. Pat. No. 3,843,424, to use a Fe-5 to 35% Co alloy, including less than 2% Cr and less than 3% Si, and having a Goss texture obtained by primary recrystallization and normal grain growth. Fe-27% Co-0.6% Cr or Fe-18% Co-0.6% Cr compositions are cited as making it possible to achieve 2.08 T at 800 A·m and 2.3 T at 8000 A/m. During operation, these values would make it possible, relative to a G.O. Fe-3% Si sheet operating at 1.8 T at 800 A/m, and at 1.95 T at 5000 A·m, to increase the magnetic flux in a given yoke cross-section by 15% at 800 A/m and by 18% at 5000 A/m, and therefore to reduce the volume or mass of the transformer proportionally. Thus, several compositions and methods for manufacturing Fe-low Co compositions (with potential additions of alloy elements) have been proposed making it possible in general to obtain magnetic inductions at 800 A/m close to those accessible with commercial Fe-48% Co-2% V alloys, but with substantially lower (18 to 25%) Co content levels (and therefore substantially lower costs).

In summary, the various issues with which the designers of aeronautic transformers are faced can be explained in this way.

In the absence of strong requirements regarding the noise due to the magnetostriction, the compromise between the requirements of a low inrush effect, a high mass density of the transformer, good yield and low magnetic losses lead to the use of solutions involving wound metal cores made from G.O. Fe—Si, Fe—Co or iron-based amorphous materials, or solutions involving magnetic cores made from cut and stacked parts made of N.O. Fe—Si or Fe—Co.

However, these requirements regarding a low magnetostriction noise being increasingly widespread, it is not possible to meet them with the previous technologies except by increasing the volume and mass of the transformer, since it is unknown how to decrease the noise except by reducing the mean working induction $B_t$, and therefore increasing the cross-section of the core and the total mass to keep the same working magnetic flux. $B_t$ must be decreased to about 1 T, instead of 1.4 to 1.7 T for Fe—Si or Fe—Co without noise-related requirements. It is also often necessary to pad the transformer, resulting in an increase in its weight and bulk.

Only a material with a zero magnetostriction would make it possible, at first glance, to resolve the problem, and on the condition that it has a working inductance greater than that of the current solutions. Only Fe-80% Ni alloys having a saturation inductance Js of about 0.75 T and so-called "lying or cut cycle" nanocrystalline alloys for which Js is about 1.26 T have such a low magnetostriction. However, Fe-80% Ni alloys have a working inductance $B_t$ too low to procure transformers lighter than the traditional transformers. Only nanocrystallines would allow this lightening with the required low noise.

It will be recalled that a material with a narrow or cut hysteresis cycle is a material whose hysteresis cycle B=f(H) is such that its slope is relatively low, until potentially intersecting the X-axis H.

However, these nanocrystallines pose a major problem in the case of an "on board transformer" solution. They are about 20 μm thick and they are wound in a toroid in the amorphous flexible state around a rigid support, such that the shape of the toroid is retained throughout the entire heat treatment resulting in the nanocrystallization. Additionally, this support can only be removed after the heat treatment, still so that the toroid shape can be retained, and also because the toroid is next often cut in two in order to allow better compactness of the transformer by using the wound circuit technology previously described. Only impregnating resins of the wound toroid can keep it in the same shape without the support that is removed after polymerization of the resin. However, after cutting the impregnated and hardened nanocrystalline toroid in a C, a deformation of the C is observed that prevents the two parts from being placed exactly facing one another to reconstitute the closed toroid, once the windings are inserted. The fastening constraints of the Cs within the transformer can thus lead to their deformation. It is therefore preferable to keep the support, which makes the transformer heavier.

The aim of the invention is to propose a low-frequency electrical transformer design, suitable for being used in aircraft, and able to best resolve the technical problems described above, and at a lower cost.

To that end, the invention relates to an elementary module of a magnetic core of an electrical transformer of the wound type, characterized in that it is made up of a first and a second superimposed windings, respectively made from a first and second material, said first material being a crystalline material with a saturation magnetization greater than or equal to 1.5 T, preferably greater than or equal to 2.0 T, better still greater than or equal to 2.2 T, and magnetic losses of less than 20 W/kg in sinusoidal waves with a frequency of 400 Hz, for a maximum inductance of 1 T, preferably less than 15 W/kg, preferably less than 10 W/kg, and said second material being a material with an apparent saturation magnetostriction ($\lambda_{sat}$) less than or equal to 5 ppm, preferably less than or equal to 3 ppm, better still less than or equal to 1 ppm, and magnetic losses of less than 20 W/kg in sinusoidal waves with a frequency of 400 Hz, for a maximum induction of 1 T, preferably less than 15 W/kg, preferably less than 10 W/kg, the cross-sections ($S_1$; $S_2$) of the first winding and ($S_3$; $S_4$) of the second winding being such that the ratio ($S_1/(S_1+S_3)$; $S_2/(S_2+S_4)$) of each cross-section of the first material with a high saturation magnetization (Js) compared to the cross-section of the set of the two materials of the elementary module is comprised between 2 and 50%, preferably between 4 and 40%.

Said first material can be chosen from among Fe-3% Si alloys with oriented grains, Fe-6.5% Si alloys, Fe-15 to 55% total alloys of Co, V, Ta, Cr, Si, Al, Mn, Mo, Ni, W, textured or not, soft iron and ferrous alloys made up of at least 90% Fe and having Hc<500 A/m, ferritic stainless steels Fe—Cr with 5 to 22% Cr, 0 to 10% total Mo, Mn, Nb, Si, Al, V and with more than 60% Fe, non-oriented electric steels Fe—Si—Al, Fe—Ni alloys with 40 to 60% Ni having no more than 5% total additions of other elements, Fe-based magnetic amorphous materials with 5 to 25% total B, C, Si, P and more than 60% Fe, 0 to 20% Ni+Co and 0 to 10% other elements, all of these content levels being given in percentages by weight.

Said second material can be chosen from among Fe-75 to 82% Ni-2 to 8% (Mo, Cu, Cr, V) alloys, cobalt-based amorphous alloys, and FeCuNbSiB nanocrystalline alloys.

Said second material can be a nanocrystalline material with composition:

$$[Fe_{1-a}Ni_a]_{100-x-y-z-\alpha-\beta-\gamma}Cu_xSi_yB_zNb\alpha M'\beta M''\gamma$$

with $a \leq 0.3$; $0.3 \leq x \leq 3$; $3 \leq y \leq 17$, $5 \leq z \leq 20$, $0 \leq \alpha \leq 6.0 \leq \beta \leq 7$, $0 \leq \gamma \leq 8$, M' being at least one of the elements V, Cr, Al and Zn, M" being at least one of the elements C, Ge, P, Ga, Sb, In and Be.

It may include an air gap (17) dividing it into two parts.

The air gap separating the two parts of the first windings can be different from the air gap separating the two parts of the second windings.

Said two parts can be symmetrical.

The invention also relates to a single-phase electric transformer magnetic core, characterized in that it is made up of an elementary module of the preceding type.

The invention also relates to a single-phase electric transformer, including a magnetic core and primary and secondary windings, characterized in that the magnetic core is of the preceding type.

The invention also relates to a three-phase electric transformer magnetic core, characterized in that it includes:

- an inner magnetic sub-core made up of two elementary modules according to one of claims 1 to 6, alongside one another; and
- an outer magnetic sub-core made up of two additional superimposed windings, positioned in this order around the inner magnetic sub-core:
  - a first winding made from a strip of the material with low magnetic losses of less than 20 W/kg in sinusoidal waves with a frequency of 400 Hz, for a maximum induction of 1 T, preferably below 15 W/kg, preferably below 10 W/kg, and with a saturation apparent magnetostriction less than or equal to 5 ppm, preferably less than or equal to 3 ppm, better still less than or equal to 1 ppm;
  - a second winding made from a strip of the material with a high saturation magnetization greater than or equal to 1.5 T, preferably greater than or equal to 2.0 T, better still greater than or equal to 2.2 T, and low magnetic losses of less than 20 W/kg in sinusoidal waves with a frequency of 400 Hz, for a maximum induction of 1 T, preferably below 15 W/kg, preferably below 10 W/kg;

the cross-section ($S_{13}$) of the first winding of the outer magnetic sub-core and the cross-section ($S_{14}$) of the second winding of the outer magnetic sub-core being such that the ratio ($S_{14}/(S_{13}+S_{14})$) of the cross-section of the material with a high saturation magnetization and the cross-section of the set of the two materials of the outer magnetic sub-core is comprised between 2 and 50%, preferably between 4 and 40%, and the cross-section of material with a high saturation magnetization (Js) in the assembly of the core, in terms of ratio of cross-sections, relative to the total cross-sections of the two types of materials in the assembly of the core $$\left(\frac{(S_3+S_4+S_{14})}{S_1+S_2+S_{13}+S_3+S_4+S_{14}}\right)$$

being comprised between 2 and 50%, preferably between 4 and 40%.

Said first winding of the outer magnetic sub-core can be made from a material chosen from among Fe-75 to 82% Ni-2 to 8% (Mo, Cu, Cr, V) alloys, cobalt-based amorphous alloys, and FeCuNbSiB nanocrystalline alloys.

Said first winding (13) of the outer magnetic sub-core can be made from a nanocrystalline material with composition:

$$[Fe_{1-a}Ni_a]_{100-x-y-z-\alpha-\beta-\gamma}Cu_xSi_yB_zNb\alpha M'\beta M''\gamma$$

with $a \leq 0.3$; $0.3 \leq x \leq 3$; $3 \leq y \leq 17$, $5 \leq z \leq 20$, $0 \leq \alpha \leq 6$, $0 \leq \beta \leq 7$, $0 \leq \gamma \leq 8$, M' being at least one of the elements V, Cr, Al and Zn, M" being at least one of the elements C, Ge, P, Ga, Sb, In and Be.

Said second winding of the outer magnetic sub-core can be made from a material chosen from among Fe-3% Si alloys with oriented grains, Fe-6.5% Si alloys, Fe-15 to 50% total alloys of Co, V, Ta, Cr, Si, Al, Mn, Mo, Ni, W, textured or not, soft iron and ferrous alloys made up of at least 90% Fe and having Hc<500 A/m, ferritic stainless steels Fe—Cr with 5 to 22% Cr, 0 to 10% total Mo, Mn, Nb, Si, Al, V and with more than 60% Fe, non-oriented electric steels Fe—Si—Al, Fe—Ni alloys with 40 to 60% Ni with no more than 5% total additions of other elements, Fe-based magnetic amorphous materials with 5 to 25% total B, C, Si, P and more than 60% Fe, 0 to 20% Ni+Co and 0 to 10% other elements.

Said core may include an air gap dividing it into two parts.

The air gap separating the two parts of the first windings of the inner magnetic sub-core and the two parts of the second winding of the outer magnetic sub-core can be different from the air gap separating the two parts of the second windings of the inner magnetic sub-core and the two parts of the first winding of the outer magnetic sub-core.

The various air gaps separating the two parts of the various windings may not all be identical between the inner magnetic sub-core and the outer magnetic sub-core.

The ratio between the cross-section ($S_{13}$) of the first winding of the outer magnetic sub-core and the cross-section ($S_3$; $S_4$) of the second windings of the inner magnetic sub-core can be comprised between 0.8 and 1.2.

The ratio between the cross-section ($S_{14}$) of the second winding of the outer magnetic sub-core and the cross-section ($S_1$; $S_2$) of the first windings of the inner magnetic sub-core can be comprised between 0.3 and 3.

Said two parts can be symmetrical.

The invention also relates to a three-phase electric transformer, including a magnetic core and primary and secondary windings, characterized in that the magnetic core is of the preceding type.

The invention also relates to a method for manufacturing a single-phase electric transformer magnetic core of the preceding type, characterized in that it includes the following steps:

manufacturing a magnetic metal support in the form of a first winding made from a first material, said first material being a crystalline material with a high saturation magnetization greater than or equal to 1.5 T, preferably greater than or equal to 2.0 T, better still greater than or equal to 2.2 T, and low magnetic losses of less than 20 W/kg at a frequency of 400 Hz in sinusoidal waves, for a maximum induction of 1 T;

winding, on said metal support, a second winding made from a material having, or being intended to have, after a nanocrystallization annealing, a saturation apparent magnetostriction less than or equal to 5 ppm, preferably less than or equal to 3 ppm, better still less than or equal to 1 ppm, and magnetic losses less than 20 W/kg in sinusoidal waves with a frequency of 400 Hz, for a maximum induction of 1 T, preferably less than 15 W/kg, preferably less than 10 W/kg and 2 to 50% in proportion of cross-section of material with a high saturation magnetization;

optionally, performing a nanocrystallization and contraction annealing of said second winding on said support; and securing the two windings, for example by sintering, or by gluing, or by impregnating using a resin and polymerization of said resin.

It may include the following steps:

producing an inner magnetic sub-core made up of two elementary modules, each elementary module being produced as follows:

manufacturing a magnetic metal support in the form of a first winding made from a first material, said first material being a crystalline material with a high saturation magnetization greater than or equal to 1.5 T, preferably greater than or equal to 2.0 T, better still greater than or equal to 2.2 T, and low magnetic losses of less than 20 W/kg in sinusoidal waves with a frequency of 400 Hz, for a maximum induction of 1 T;

winding, on said metal support, a second winding made from a material having, or being intended to have, after a nanocrystallization annealing, an apparent saturation magnetostriction less than or equal to 5 ppm, preferably less than or equal to 3 ppm, better still less than or equal to 1 ppm, and magnetic losses less than 20 W/kg in sinusoidal waves with a frequency of 400 Hz, for a maximum induction of 1 T, preferably less than 15 W/kg, preferably less than 10 W/kg, the ratio of the cross-section of material with a high saturation magnetization (Js) to the total of the cross-sections of the materials of the first and second windings being from 2 to 50%, preferably from 4 to 40%;

optionally, performing a nanocrystallization and contraction annealing of said second winding on said support;

placing said elementary modules alongside one another along one of their sides, in order to form said inner magnetic sub-core;

producing an outer magnetic sub-core as follows:

positioning, around the inner magnetic sub-core, a third winding made from a strip of material having, or being intended to have, after a nanocrystallization annealing, an apparent saturation magnetostriction less than or equal to 5 ppm, preferably less than or equal to 3 ppm, better still less than or equal to 1 ppm, and magnetic losses less than 20 W/kg in sinusoidal waves with a frequency of 400 Hz, for a maximum induction of 1 T, preferably less than 15 W/kg, preferably less than 10 W/kg;

optionally, performing a nanocrystallization and contraction annealing of said third winding on the inner magnetic sub-core;

positioning, around said third winding, a fourth winding made from a material with a high saturation magnetization greater than or equal to 1.5 T, preferably greater than or equal to 2.0 T, better still greater than or equal to 2.2 T, and low magnetic losses of less than 20 W/kg in sinusoidal waves with a frequency of 400 Hz, for a maximum induction of 1 T, the ratio of the cross-section of material with a high saturation magnetization to the total of the cross-sections of the materials of the third and fourth windings being from 2 to 50%, preferably from 4 to 40%, and the proportion of material with a high saturation magnetization in the entire core, in terms of ratios of cross-sections, relative to the total cross-sections of the two types of materials, being comprised between 2 and 50%, preferably between 4 and 40%;

and securing said windings, for example by sintering, or by gluing, or by impregnating using a resin and polymerization of said resin.

Said magnetic transformer core is cut so as to form to elementary cores, said elementary cores next being intended to be reassembled so as to define an air gap between them.

The two elementary cores can be symmetrical.

The surfaces of the elementary cores intended to define the air gap can be worked and surfaced before the elementary cores are reassembled.

It is possible to perform the working and surfacing such that the surfaces intended to define the air gap separating the first windings of the two elementary cores define an air gap different from the air gap separating the second windings of the two elementary cores.

The two elementary cores can be reassembled by hooping using a crystalline material with a high saturation magnetization greater than or equal to 1.5 T, preferably greater than or equal to 2.0 T, better still greater than or equal to 2.2 T, and low magnetic losses of less than 20 W/kg in sinusoidal waves with a frequency of 400 Hz, for a maximum induction of 1 T.

The inventors surprisingly noted that, with a view to converting the electricity to frequencies of about several hundred Hz, or even several kHz, for example in aeronautic transformers, where a high volume and/or mass power density, a low to very low emitted noise, low magnetic losses in sinusoidal waves from the magnetic core (less than 20 W/kg at 400 Hz, preferably less than 15 W/kg and preferably less than 10 W/kg, for a maximum inductance of 1 T) and losses by Joule effect (from conductors), and a sufficient damping of the inrush effect (inrush current upon priming a transformer) are simultaneously demanded, the configuration in a "composite" wound magnetic core, i.e., made up of a wound magnetic core using at least two materials of clearly different natures through the composition or properties and such that at least one of these materials makes up the majority of the volume and has a low apparent saturation magnetostriction (typically $\lambda_{sat} \leq 5$ ppm, preferably $\leq 3$ ppm, and better still $\leq 1$ ppm) with low magnetic losses at 40 Hz and at least another of these materials has a high saturation magnetization, typically Js≥1.5 T, preferably ≥2.0 T, and better still ≥2.2 T), has the following advantages (in particular in reference to the highest performing current solution and using 100% nanocrystalline material):

good mechanical strength of the composite core assembly, under the effect of winding stresses, thermal stresses during annealing operations, and maintaining stresses during cutting into Cs of the core (which is only optional, but is preferred), maintaining stresses during surfacing operations of the cut zones, stresses to keep the Cs in a stable position under the adjusted air gap;

a significant reduction in the number of manufacturing operations and the overall manufacturing cost, in particular through the lower consumption of nanocrystalline material (all other things being equal), and through the use of the winding support of the invention not only as mechanical support, but also as inrush effect damper and as converter for converting energy in a steady conversion state, in addition to the nanocrystallization circuit;

a volume and/or mass power density equivalent, or even slightly better, relative to the solution using 100% nanocrystalline, and greatly superior to the other single-material solutions still very widely used and based on wound FeCo or FeSi, and where the low enough emitted noise is obtained by downgrading the working induction, and therefore necessarily making the transformer heavier.

Figure 2:
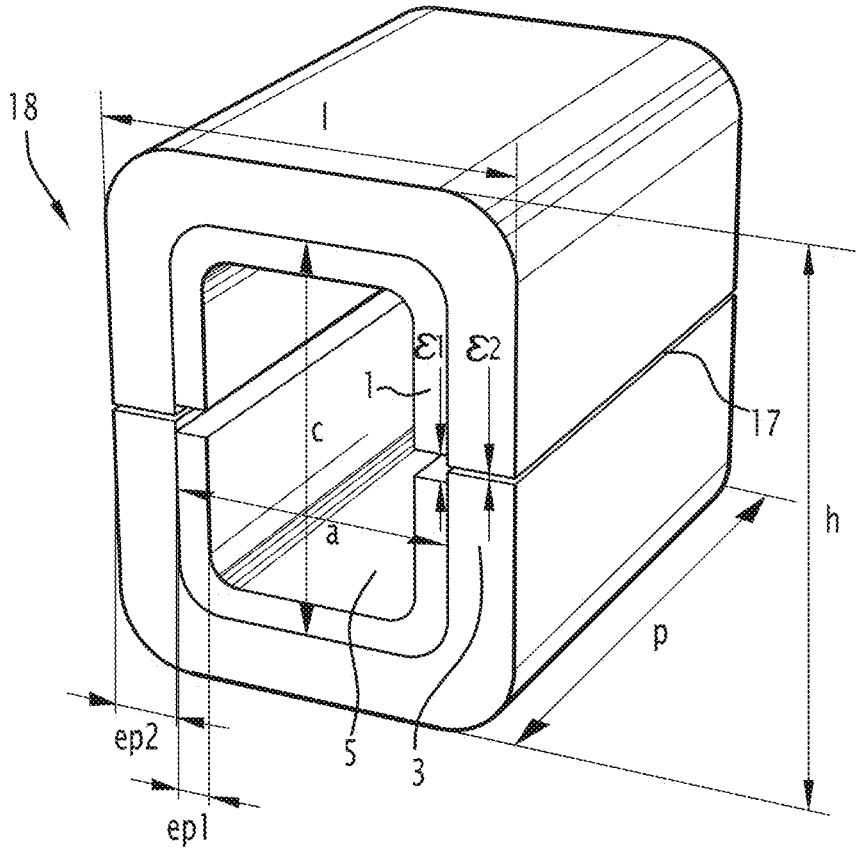
Figure 3:
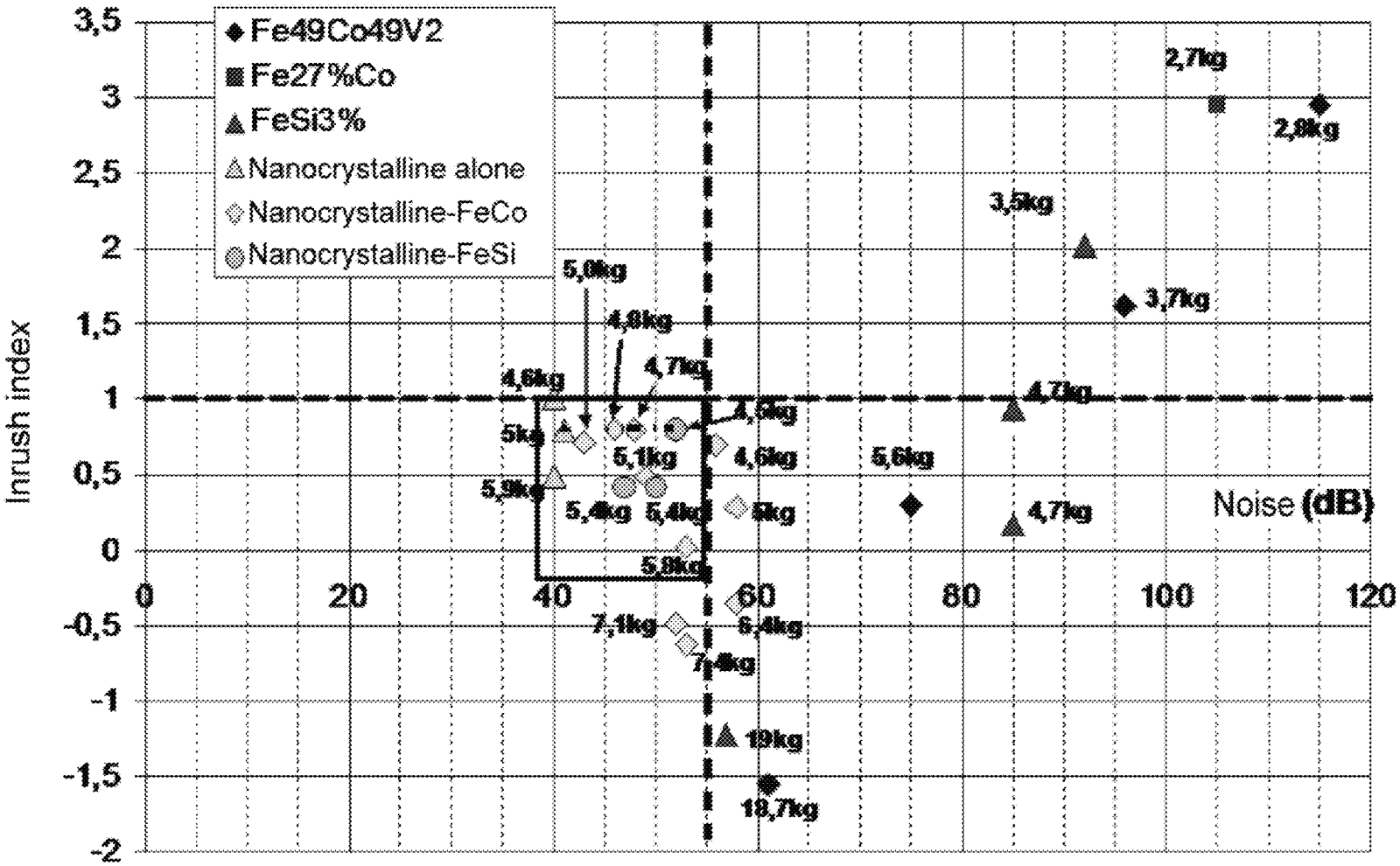

The invention will be better understood upon reading the following description, in reference to the following appended figures:

FIG. 1 schematically shows an example three-phase transformer core according to the invention, with the windings of the transformer;

FIG. 2 schematically shows an example sub-core of the three-phase transformer of FIG. 1, which can also be used to form a single-phase transformer core;

FIG. 3 shows the relationships between noise, inrush index and mass of the core in the reference examples and the examples according to the invention described in the description.

It has been stated that one of the main problems posed by the typical transformers used in aircraft consists of their sound level, which is bothersome for conversations between crewmembers.

The noise of the transformers comes from two sources: the magnetic forces and the magnetostriction of the magnetic materials used in the cores of these transformers.

The noise from the magnetic forces can be reduced fairly easily in a closed magnetic circuit with very small distributed air gaps, by suitable mechanical systems for maintaining the various elements made from electromagnetic materials (conductors and magnetic sheets).

Conversely, the magnetostrictive noise is based on the oftentimes non-zero magnetostriction and anisotropic characteristics of the ferromagnetic crystal, and also the magnetic flux, which often changes direction in these crystals. Logically, to reduce, or even cancel out, this type of noise, it is necessary to:

either choose a material with a low or zero magnetostriction characteristics (example: alloy FeNi80, called "Mumetal");

or have a magnetic material and the transformer structure for which the magnetic flux only propagates along the same crystallographic direction.

The magnetostrictive phenomena must be considered with several deformation ($\lambda_{100}$, $\lambda_{111}$, $\lambda_{sat}$) or energy properties.

The magnetostriction constants $\lambda_{100}$ and $\lambda_{111}$ represent the coupling amplitude between local magnetization of the network along the crystallographic axes <100>, <111>, respectively. This coupling is therefore also anisotropic with respect to the crystallographic plane of reference, such that for a supposedly uniform magnetization of the metal (and therefore, with a given direction in the plane of reference of the sample, and therefore also a specific direction in each of the considered crystals), each crystal would tend to deform differently from its neighbor (the crystallographic orientations necessarily being different), but will be prevented from doing so by the intergranular mechanical cohesion. The elastic constraints resulting therefrom, which can be depicted in a simplified manner by a property $\sigma_i$, cause a magnetoelastic energy, of the order of magnitude $(3/2)\lambda\sigma_i$, which partially demagnetizes the material (in this expression, A approximately represents a mean magnetostriction of the same order of magnitude as the constant $\lambda_{100}$ and $\lambda_{111}$). Except in certain cases (for example, traction exerted on the FeSi-G.O. alloys), the application of an external stress also downgrades the performance: this is the inverse effect of the magnetostriction. These magnetostriction stresses $\lambda_{100}$ and $\lambda_{111}$ depend very primarily on the composition, and also the crystallized fraction in the case of a nanocrystalline material, and they are known for a certain number of materials.

$\lambda_{sat}$ is the saturation apparent magnetostriction. The properties $\lambda_{100}$ and $\lambda_{111}$ relate to the magnetostriction deformations along the axes <100> and <111> of a free monocrystal to deform. The behavior of an industrial material (therefore generally polycrystalline) introduces the inner elastic constraint $\sigma_i$ due to the different crystallographic orientations present, which amounts to generating the deformation of each of the crystals. This results in a global magnetostriction, called "apparent magnetostriction" of the material, measured from the demagnetized state, and not having a strict explicit relationship with the constants $\lambda_{100}$ and $\lambda_{111}$, other than the same order of magnitude. This apparent negative restriction $\lambda_{sat}$ is determined after saturation, and therefore represents the maximum deformation amplitude of the material when it is magnetized, relative to its initial state, "demagnetized" or not, which in all cases is an unknown initial deformation state. $\lambda_{sat}$ is therefore a variation in deformation state between two poorly identified states. $\lambda_{sat}$ is thus a commonly used value that occurs at the first order in the vibration of the magnetic sheets, the noise emitted or the deformation compatibility between the magnetic material and its immediate vicinity (for example, the seizing of a passive component magnetic core, field sensor, signal transformer, etc.).

In a material without a pronounced texture (the effect of a texture will be seen below) and having magnetostriction coefficients very different from 0, such as an electric steel Fe 3% Si—N.O. that has no texture or only a subtle texture, then in the excitation phases of the material in the transformer, the magnetic magnetization will alternate periodically in all points of the material in its easy magnetization direction (little or no excitation field) and a local direction more or less close to the Rolling Direction DL. This alternating, which is different from one grain to another in the metal, associated with different magnetostriction coefficients $\lambda_{100}$ and $\lambda_{111}$, creates cyclic deformations of the metal, which are the source of the acoustic noise emitted by these vibrations.

Regarding the low magnetic losses at medium frequency, it is necessary to know that two properties influence the choice of the most appropriate material:

- the accessible induction B(Hm) that is situated around 90% of the saturation in order to use the material maximally while limiting the magnetizing A.tr and the harmonics generated by the nonlinearity B—H;
- and the magnetic losses.

In aeronautics, the on board network has long been at a fixed frequency of 400 Hz, but the variable frequency (typically 300 Hz to several kHz) provided directly by the generators is increasingly used. In this relatively low "medium frequencies", it is interesting to have a material with a high induction and low losses (the thermal dimensioning also conditions the volume and the mass of the transformer), such as thin Fe—Co alloys, G.O. or N.O. thin Fe—Si electric steels with a high saturation, optionally Fe-6.5% Si. This frequency range corresponds to skin thicknesses smaller than 1/10 mm, which is fully compatible with the need for thicknesses of this type in the case of a magnetic core technology of the wound type according to the invention. About 0.1 mm, it becomes increasingly difficult to wind the metal in a toroidal form.

Consequently, if only the material magnetic losses with a high Js are considered so as to reduce the mass and volume of the magnetic core, the choice of the main known accessible materials corresponds to table 1 below. Materials with a high Js are used in the invention to operate very primarily in a temporary state in order to damp the inrush effect. Consequently, it is primarily materials with a low magnetostriction, seeing to most of the operation in the permanent state of the transformer, that will emit the magnetic losses.

Due to the thermal confinement of the transformer cores, the magnetic losses must remain low as well as the losses by Joule effect of the conductors, in order to keep an ambient temperature of the inner transformer below 150° C., in a cooling state without forced convection. Typically, it is standard to consider that the magnetic losses of an on board transformer core must not exceed 20 W/kg of installed magnetic material, preferably less than 15 W/kg, and better still less than 10 W/kg, for a maximum induction of 1 K under a sinusoidal field with a frequency of 400 Hz (corresponds to 2 T/400 Hz, at less than 80 W/kg, respectively, and preferably less than 60 W/kg, and better still, less than 40 W/kg). This condition must be met by the materials of all of the windings of the core of the transformer.

Table 1 below shows that the amorphous or nanocrystalline materials comply with the strictest limitations on magnetic losses (<5 W/kg).

The nanocrystalline material FeCuNbSiB given as an example in the various tables has the standard composition $Fe_{73.5}Cu_1Si_{15}B_{7.5}Nb_3$.

TABLE 1

Technical characteristics of different magnetic materials for on board transformers

| Material | Thickness (mm) | $\rho_{el}$ (μΩ · cm) | $\rho_{vol}$ (kg/m³) | Magnetic losses at 1 T (in W/kg) 400 Hz | 1 kHz | 5 kHz | $B_t$ (T) | Hm ($B_t$) (in A/m) 400 Hz | 1 kHz |
|---|---|---|---|---|---|---|---|---|---|
| FeSi-N.O. | 0.1 | 48 | 7650 | 11 | 33 | 350 | 1.8 | 5000 | 5500 |
| FeSi-G.O. | 0.05 | 48 | 7650 | 8 | 22 | 200 | 1.8 | 80 | 90 |
| Fe-50% Co | 0.1 | 45 | 8200 | 7.5 | 23 | 250 | 2.1 | 500 | 550 |

TABLE 1-continued

Technical characteristics of different magnetic materials for on board transformers

| Material | Thickness (mm) | $\rho_{el}$ (μΩ · cm) | $\rho_{vol}$ (kg/m$^3$) | Magnetic losses at 1 T (in W/kg) 400 Hz | 1 kHz | 5 kHz | $B_t$ (T) | Hm ($B_t$) (in A/m) 400 Hz | 1 kHz |
|---|---|---|---|---|---|---|---|---|---|
| Amorphous 2605SC | 0.025 | 125 | 7320 | 1.6 | 6 | 65 | 1.5 | 40 | 64 |
| Amorphous 2605CO | 0.025 | 130 | 7560 | 4.5 | 18 | 210 | 1.6 | 40 | 60 |
| Fe-6.5/Si | 0.1 | 75 | 7400 | 6 | 17 | 180 | 1.2 | 60 | 60 |
| Fe-50% Ni (Supra 50) | 0.05 | 48 | 8200 | 3 | 10 | 150 | 1.5 | 56 | 70 |
| Nanocrystalline FeCuNbSiB | 0.02 | 115 | 7300 | 0.3 | 1 | 30 | 1.1 | 8 | 8.5 |

with $\rho_{el}$: electrical resistivity at 20° C. and $\rho_{vol}$: density at 20° C.

The work induction $B_t$ serves to size the magnetic circuits (FeSi, FeCo) when the frequency does not exceed 1 kHz, since the magnetic losses remain modest, therefore easy to discharge. Beyond 1 kHz, the losses require the use of a larger cooling system or the imposition of a decrease of $B_t$ (due to the fact that the losses are related to the square of $B_t$): the iron-based amorphous materials then appear to be an interesting alternative (lower $B_t$, but much lower losses): indeed, the lower saturation magnetization of the amorphous materials is then no longer a drawback, while their low magnetic losses represent a major advantage.

The trend in civil aeronautics is to design on board transformers with an increasingly low emitted noise, or even very low when it is situated next to the cockpit, and pilots are working without a headset to communicate. Like any other on board component, the transformer must be as light and compact as possible, consume as little current as possible, and generate as little heat as possible, and must be able to absorb major load variations, i.e., major variations in the inrush current of the transformer, without suffering damage to its integrity (its insulating components, electronic components). This inrush current must be as low as possible.

It is established in the recent literature that the maximum inrush current (temporary magnetizing current of a transformer) is proportional to $(2B_t+B_r-B_s)$, where $B_t$ is the nominal work induction (from the dimensioning of the magnetic circuit), $B_r$ is the remanent induction of the magnetic circuit (i.e., of the assembly formed by the ferromagnetic core and air gaps localized or distributed depending on the structure of the core), and $B_s$ is the saturation induction of the core.

To obtain a low maximum inrush current, the following is required:

- a material with a strong saturation magnetization (FeSi or FeSo, which are preferred by comparison with FeNi and nanocrystallines);
- a magnetic circuit with low remanence, which can be obtained either directly through the choice of its component material (example of the narrow hysteresis cycle of the nanocrystalline alloys), or by a construction effect of the yoke (distributed or localized air gaps, producing a sufficient demagnetizing field);
- a low work induction $B_t$; but this is contradictory with the high power density, the miniaturization and lightening of the transformers, and therefore does not constitute a satisfactory solution to the problem posed;
- a small magnetic core cross-section, which would lead to using a material with a high saturation;
- a large cross-section of the coils.

In short, if we only consider the inrush current, the ideal magnetic circuit includes an alloy with a high saturation magnetization (FeSi, FeCo) and low remanence, used at a reduced induction: this goes through an optimized design and sizing and an appropriate calibration of the air gap(s) from these materials with a high saturation magnetization Js.

If we add up the low bulk and low mass, low magnetic loss, low to very low acoustic noise and low inrush effect constraints in an on board aeronautic transformer, the intersection of the most interesting solutions must still be found to optimize each restrictive property previously seen. Table 2 provides a synthesis of these properties in the case of a wound magnetic core cut into two C-shaped elements, with a small and calibrated air gap (hence a low $B_t$) and for a same magnetic core mass, in the different cases where a single material is used to form the core. The characteristics of certain materials are provided for different values of $B_t$ and/or Hc.

TABLE 2

Expected properties of materials usable to form a single-material core

| Material | Thickness (mm) | Hc (A/m) | $B_t$ (T) | Power density | Acoustic noise emitted | Magnetic losses | A.tr and conductive losses | Inrush effect | Cost |
|---|---|---|---|---|---|---|---|---|---|
| Ideal material | | | | excellent | excellent | excellent | excellent | excellent | excellent |
| Fe3% Si-N.O. | 0.1 | 40-50 | 1.8 | very good | mediocre | mediocre | mediocre | mediocre | excellent |
| Fe3% Si-G.O. | 0.1 | 20 | 1.8 | very good | low | good | good | mediocre | excellent |
| Fe3% Si-G.O. | 0.05 | 25 | 1.8 | very good | low | very good | good | mediocre | excellent |
| Fe3% Si-G.O. | 0.05 | 25 | 1 | low | good | very good | Very good | good | excellent |
| Fe3% Si-G.O. | 0.05 | 25 | 0.5 | poor | Very good | excellent | excellent | excellent | excellent |
| Fe-50% Co | 0.1 | 56 | 2.1 | excellent | poor | mediocre | mediocre | mediocre | low |

TABLE 2-continued

Expected properties of materials usable to form a single-material core

| Material | Thickness (mm) | Hc (A/m) | $B_t$ (T) | Power density | Acoustic noise emitted | Magnetic losses | A.tr and conductive losses | Inrush effect | Cost |
|---|---|---|---|---|---|---|---|---|---|
| Fe-50% Co | 0.05 | 54 | 2.1 | excellent | poor | low | mediocre | mediocre | low |
| Fe-50% Co | 0.05 | 54 | 0.5 | mediocre | good | Very good | Very good | excellent | low |
| Iron-based amorphous material 2605CO | 0.025 | 4 | 1.6 | very good | mediocre | Very good | very good | low | low |
| Iron-based amorphous material 2605CO | 0.025 | 4 | 1 | low | good | excellent | excellent | excellent | low |
| Fe-6.5/Si | 0.1 | 10 | 1.5 | very good | good | good | low | good | good |
| Fe-50% Ni {100} <001> | 0.05 | 8 | 1.5 | very good | very good | Good | good | mediocre | good |
| Fe-50% Ni {100} <001> | 0.05 | 8 | 0.7 | mediocre | excellent | very good | very good | excellent | Good |
| Nanocrystalline FeCuNbSiB | 0.02 | 1 | 1.1 | good | excellent | excellent | excellent | mediocre | Good |
| Nanocrystalline FeCuNbSiB | 0.02 | 1 | 0.6 | mediocre | excellent | excellent | excellent | excellent | good |
| Cobalt-based amorphous material | 0.025 | 1 | 0.7 | mediocre | excellent | excellent | excellent | mediocre | poor |
| Cobalt-based amorphous material | 0.025 | 1 | 0.3 | poor | excellent | excellent | excellent | excellent | poor |
| Fe-81% Ni-5% Mo Mumetal | 0.05 | 1 | 0.7 | mediocre | excellent | very good | excellent | mediocre | mediocre |

(Decreasing assessments of interest: excellent > very good > good > low > mediocre > poor)

It appears that with such single-material solutions thus known from the prior art, there are three types of choices, listed below:

- either one uses conditions of a material with low magnetic losses associated with small thicknesses and low inductions (Fe-3% Si-G.O. at $B_t$ of 0.5 T, Fe-50% Co at $B_t$ of 0.5 T, Fe-50% Ni {100}<001> at $B_t$ of 0.7 T, nanocrystalline $Fe_{73.5}Cu_1Si_{15}B_{7.5}Nb_3$ (the index numbers correspond to atomic percentages, as is standard practice in defining such materials) at $B_t$ of 0.6 T, cobalt-based amorphous material at $B_t$ of 0.3 T), and one then achieves very good performance levels in terms of dissipated losses, emitted acoustic noise, A.tr, conductive losses and inrush effect, but the power density is that greatly downgraded;
- or one uses a high inductance (1.5 to 2 T) made from different materials and what achieves good to very good power densities, but then the inrush effect and the acoustic noise are significantly increased, and in any case well beyond what is currently accepted;
- or one uses a nanocrystalline material of the aforementioned type, the latter differing by a work induction of about 1 T and making it possible to satisfy, at least acceptably, all of the fundamental needs with an acceptable inrush, a low noise, low magnetic losses, low A.tr (and therefore conductive losses), but with an average power density.

In a wound toroid, the known nanocrystallines for this use therefore constitute the best compromise solution. But to make it even more interesting, it would be necessary to find a way to do without the retention of the winding support to decrease the total mass. Additionally, an even better compromise between the mass and the different usage values required from an on board aeronautic transformer with a metal yoke having a wound core, subject to a medium frequency of several hundred Hz to several kHz, whether single-phase or three-phase, would be desirable.

This aim is achieved by the following general solution according to the invention, developed here in the most restrictive case of a three-phase transformer, illustrated in FIG. 1. This figure is merely a block diagram, and does not show the mechanical support and assembly parts making it possible to maintain the various functional parts. However, one skilled in the art will easily be able to design these parts by adapting them to the specific environment in which the transformer according to the invention is intended to be placed.

The elementary module of the invention is a magnetic core, of the wound type known in itself, but made by associating two different soft magnetic materials, in different proportions. One, making up the majority in cross-section (in other words, in volume, since all of the elements of the module have the same depth), differs by a low magnetostriction, the other, making up the minority in cross-section, being distinguished by a strong saturation magnetization Js and serving as mechanical support for the first material, inrush limiter, and plays a minor, but non-negligible role in the energy transformation in the steady state. These materials may optionally be present with identical sections/volumes, but the material with a high saturation magnetization Js must not exceed the section/volume of the material with a low magnetostriction.

The inventors have in fact surprisingly noted that in such a configuration, the nanocrystalline cores (materials with a low magnetostriction) wound around the first wound core and previously manufactured from a crystalline material with a high saturation magnetization (Fe, Fe—Si, Fe—Co, etc.) not only were mechanically strong, since the support here is retained (not only as a mechanically useful part, but above all as an essential part to the electromagnetic operation of the transformer), but the power density obtained remains at the same level as that of a nanocrystalline core with no support. Of course, here, we do not have the drawbacks that would be related to an absence of support, i.e., the geometric instability of the nanocrystalline core, and the possible alterations of the operation of the transformer that would result therefrom. If the material of the crystalline core is chosen well, one obtains, in addition to the support function of the nanocrystalline core, significant advantages for the overall operation of the transformer. These advantages are a limitation of the inrush effect in the transitional state and, in the steady state, a good transformation of the energy under a medium alternating frequency, such that the power density of the transformer is not downgraded relative to that which it would have with a "nanocrystalline material alone" solution, allowing that one manages, in the latter case, to retain good geometric stability under stress of the two C-shaped half-cores.

We will now describe, in the order of manufacturing of a three-phase magnetic core according to the invention (association of three elementary modules), the various possible components and the characteristics of a transformer structure according to the invention resulting from this manufacturing. This structure is shown schematically in FIG. 1.

One begins by manufacturing an inner magnetic sub-core wound composite structure, this sub-core being made up of two elementary modules alongside one another. The term "composite structure" means that the structure uses several magnetic materials of different natures. It is formed as follows, and assembled in the order described below.

The structure first includes a winding 1, 2 of two magnetic sub-cores each made from a strip of material formed from a material with a high saturation magnetization Js and low losses, such as Fe-3% Si alloys with oriented grains, Fe-6.5% Si alloys, Fe-15 to 55% total alloys of Co, V, Ta, Cr, Si, Al, Mo, Ni, Mn, W, textured or not, soft iron and ferrous alloys made up of at least 90% Fe and having a coercivity He of less than 500 A/m, ferritic stainless steels Fe—Cr containing 5 to 22% Cr, 0 to 10% total Mo, Mn, Nb, Si, Al, V and with more than 60% Fe, non-oriented electric steels Fe—Si—Al, Fe—Ni alloys containing 40 to 60% Ni with no more than 5% total additions of other elements, Fe-based magnetic amorphous materials containing 5 to 25% total B, C, Si, P and more than 60% Fe, 0 to 20% total Ni and Co and 0 to 10% other elements.

These two windings 1, 2 each make up the (inner) winding support of one of the two inner magnetic sub-cores of the transformer. Preferably, this winding is self-supported after removal from the winder, but it may itself be wound on a more rigid support that is as light as possible so as not to make the transformer significantly heavier, this support being made from any type of material, magnetic or not.

The function of these windings 1, 2 of the inner magnetic sub-core is to dimensionally stabilize the C-shaped final magnetic circuit, and also to absorb the very substantial A.tr and the spikes that occur during powering on, the connection of the transformer to the grid, the abrupt demand of a charge, etc., and that cause a significant inrush in the transformer (inrush effect). This sub-part 1, 2 made from a high Js material, in a transformer dimensioned for a work induction with much lower nanocrystallines (slightly below the Js of a material with a low magnetostriction, i.e., ≤1.2 T), will then be saturation magnetized during the inrush duration (which varies from several seconds to 1 to 2 min.) from $B_r$. This makes it possible to store much more magnetization energy in this form in these high Js materials, and prevents this energy from being passed onto a hypersaturation of the material section with a low magnetostriction and low Js, which would cause enormous excitation fields and inrush currents.

High Js materials are desirable, since if the requirement was only to absorb the temporary A.tr through substantial energy storage, it would suffice to have a minimal permeability $\mu_r$ of at least 10 to 100 in the temporary field period H during the inrush phenomenon, which would quickly become higher than the permeability under inrush field of the materials with a high permeability, low magnetostriction and low Js, falling from very high values ($\mu_r$>100,000) to a value close to the unit in hypersaturation zone B—H.

However, the requirement is not only to withstand the temporary A.tr for these high Js materials, but also not to shield the inner materials of the magnetic transformer yoke in the steady state. Indeed, for variable frequencies ranging from 300 Hz to 1 kHz (or more), which are encountered increasingly often in on board aeronautic grids, the skin thickness is from 0.05 to 0.2 mm (depending on the material, the frequency and the permeability of the environment). Therefore, a winding of a high Js material having an excessively low thickness relative to the skin thickness would shield the outside field from the windings, particularly when there are large number of metal turns with a high Js in the winding. It is therefore preferably necessary to use a high Js material with a small thickness (0.05 to 0.1 mm).

Additionally, it is desirable to retain a very low acoustic noise during the operation of the transformer in the steady state, despite the presence of part of the magnetic yoke made from a high Js material and with a magnetostriction going from "medium" to "strong". It is therefore necessary for the latter materials not to be magnetically active in the steady state of the transformer, or at least for them to operate at a low enough induction operating point for the acoustic noise emitted to be very weak. To that end, it is necessary for the permeability of the low magnetostriction materials to be much higher (1 to 2 orders of magnitude) at 300 Hz-1 kHz than the permeability of high Js materials. This is achieved by using nanocrystalline or cobalt-based amorphous materials on the one hand ($\mu_r$ at 1 kHz>50,000-100,000) and thin FeSi or FeCo alloys ($\mu_r$ at 1 kHz<3000), or Fe-80% Ni alloys by reducing their thickness sufficiently (<0.07 mm) on the other hand.

The high Js materials may for example be all Fe-3% Si alloys with a so-called Goss texture {110}<001>, known in the "electric steels" under the names of two sub-families:

FeSi-G.O. for Grain Oriented; and

FeSi-HiB for High Induction, the textures of which are tighter and the $\mu_r$ performance and losses of which are better.

This performance is obtained only in the rolling direction of the materials, which is quite suitable for wound magnetic cores, whereas when one deviates from this direction, the performance decreases very quickly.

It is also in particular possible to use the Fe-49% Co-2% V-0 to 0.1% Nb alloy, the V being able to be replaced in whole or in part by Ta and/or Zr. The performance, unlike the previous FeSi, is not related to the texture, but to the composition and optimization heat treatment, and their performance is approximately isotropic in the plane of the sheet. The performance is retained in large part when the strip thickness is lowered around 0.05-0.1 mm.

It is also in particular possible to use a Fe-10 to 30% Co alloy with little texturing or with a Goss texture, such as the preceding Fe-3% Si. In the case of a Goss texture, which makes it possible to increase the permeability and reduce the magnetic losses (but this is not particularly required for the high Js magnetic yoke part operating mainly temporarily or at a very low permanent induction), the following materials may in particular be used:

Fe-10 to 30% Co, preferably 14 to 27% Co, preferably 15 to 20% Co, also containing:

0 to 2% (Si, Al, Cr, V), preferably 0 to 1% (Si, Al, Cr, V);

0 to 0.5% Mn, preferably 0 to 0.3% Mn.

0 to 300 ppm C, preferably 0 to 100 ppm C;

0 to 300 ppm each of S, O, N, B, P, preferably 0 to 200 ppm each of S, O, N, P, B.

The rest is Fe, accompanied by impurities resulting from the melting.

These materials can be shaped and treated by:

hot rolling ending in the ferritic phase, preferably at a temperature of less than 900° C.;

then two cold rolling sequences: the first pass with a reduction rate of 50 to 80%, the second pass with a reduction rate of 60 to 80%;

annealing in the ferritic phase after hot rolling, and rapid temperature decrease (>200° C./h between Ac1 and 300° C.);

intermediate annealing (between the two cold rolling sequences) in the ferritic phase, with a slow temperature increase (<200° C./h between 300° C. and Ac1).

The different high Js ferrous materials, previously described, are illustrated by examples in the following table 3. When a content level of one of the cited elements is not specific, this means that this element is only present in trace amounts, or at a relatively low content level that leaves it without a very significant influence on the Js of the material. The possible content levels of the elements other than Co, Si, Cr and V present in the alloys have not been specified, since these elements have very little influence on the targeted magnetic properties.

The induction at 800 A/m (B800) is cited here, since in this type of high Js material, the application of a field of 800 A/m makes it possible to achieve an induction B situated around the bend of the curve B=f(H). Yet it is around the bend of the curve B=f(H) that the best compromise is achieved between volume reduction (high B) and low consumption of the transformer (low A.tr). The B8000 (induction at 8000 A/m) on the contrary takes into account the approximate saturation induction, used not only in the power density potential ($B_t$<B8000), but also in the reduction of the inrush effect.

TABLE 3 examples of high Js materials usable in the invention

| | In wt % | | | | | | | In ppm | | | B800 | B8000 |
|---|---|---|---|---|---|---|---|---|---|---|---|---|
| Alloy | Co | Si | Cr | V | C | Mn | Al | O | N | S | (T) | (T) |
| 1 | 15 | 0.02 | 0.05 | <0.005 | 0.017 | 0.25 | 0.01 | 70 | 22 | 8 | 2.08 | 2.24 |
| 2 | 15 | 1.0 | 0.03 | 0.1 | 0.016 | 0.27 | 0.02 | 48 | 17 | 11 | 1.95 | 2.18 |
| 3 | 18 | 0.05 | 0.04 | <0.005 | 0.017 | 0.32 | 0.02 | 56 | 31 | 7 | 2.12 | 2.30 |
| 4 | 18 | 1.0 | 0.007 | <0.005 | 0.017 | 0.29 | <0.01 | 62 | 25 | <5 | 2.00 | 2.23 |
| 5 | 10 | 0.03 | 0.05 | <0.005 | 0.019 | 0.33 | <0.01 | 47 | 22 | <5 | 2.01 | 2.12 |
| 6 | 27 | 0.03 | 0.5 | <0.005 | 0.015 | 0.30 | 0.01 | 82 | 28 | 6 | 2.03 | 2.28 |
| 7 | 48 | 0.008 | 0.07 | 2.0 | 0.019 | 0.28 | 0.02 | 63 | 19 | 9 | 2.10 | 2.35 |
| 8 | 0 | 3.0 | 0.007 | <0.005 | 0.017 | 0.27 | 0.01 | 51 | 18 | <5 | 1.90 | 2.00 |

The structure next includes two additional windings 3, 4. They are each superimposed on one of the windings 1, 2 made from high Js material previously described, "superimposed" meaning that the additional winding 3, 4 is positioned around the corresponding winding 1, 2 made from a high Js material that was previously produced. These additional windings 3, 4 made with a strip of a material having both low magnetic losses and a low magnetostriction, such as Fe-75 polycrystalline alloys with 82% Ni-2 to 8% (Mo, Cu, Cr, V), cobalt-based amorphous alloys, and, very preferably, FeCuNbSiB nanocrystalline alloys and the like.

One particularly recommended polycrystalline material with about 80% Ni is also known under the name Mumetal. It achieves a very low magnetostriction for a composition of 81% Ni, 6% Mo, 0.2 to 0.7% Mn, 0.05 to 0.4% Si, the rest being iron, and for an appropriate heat treatment to optimize magnetic performance, well known by those skilled in the art.

One particularly recommended nanocrystalline material, known by those skilled in the art since the 1990s, is known for its very low magnetic losses from the low frequencies up to 50-100 kHz and for its ability to adjust its magnetostriction, via appropriate compositions and appropriate heat treatments, to a zero value, or a value very close to 0. Its composition is given by the formula (the index numbers corresponding to atomic percentages, as is common practice in the definition of such materials):

$$[Fe_{1-a}Ni_a]_{100-x-y-z-\alpha-\beta-\gamma}Cu_xSi_yB_zNb\alpha M'\beta M''\gamma$$

with a≤0.3; 0.3≤x≤3; 3≤y≤17, 5≤z≤20, 0≤α≤6, 0≤β≤7, 0≤γ≤8, M' being at least one of the elements V, Cr, Al and Zn, M" being at least one of the elements C, Ge, P, Ga, Sb, In and Be, having a relative permeability $\mu_r$ comprised between 30,000 and 2,000,000, a saturation of more than 1 T, and even 1.25 T when the composition is optimized to achieve a zero magnetostriction.

During annealing, the nanocrystalline material contracts by about 1% from its initial amorphous strip state. This phenomenon must therefore be anticipated in the winding of the amorphous strip around the first inner sub-core part 1, 2 made from a high Js material, before the nanocrystallization annealing. Otherwise, the 1% retraction of the first core part may cause very substantial inner stresses on the two materials of the core, which makes the assembly fragile to the point of risking breaking and increases magnetic losses. Conversely, this retraction favors the mechanical securing of the two types of materials, and therefore favors, if it is not excessive, better dimensional stability of the C-shaped parts after impregnation and cutting.

Each of these dual-material windings (1, 3; 2, 4) constitutes an inner magnetic sub-core (called "elementary module"), defining a space 5, 6 in which two primary windings 7, 8, 9 of the three phases of the transformer and two of the secondary windings 10, 11, 12 of the three phases of the transformer will be inserted.

It should be noted that if the transformer is a single-phase transformer, only one of these elementary modules alone makes up the magnetic core of the transformer.

The structure next includes a winding 13, which is positioned around the assembly formed by said two inner magnetic sub-cores closely alongside one another along one of their sides. These winding 13 is formed from a strip of a material with low magnetic losses and low magnetostriction, such as Fe-75 alloys with 82% Ni-2 to 8% (Mo, Cu, Cr, V), cobalt-based amorphous alloys, and very preferably, FeCuNbSiB nanocrystalline alloys as defined above. This winding 13 constitutes part of the outer magnetic sub-core.

Up to and including this step, it is preferable only to keep all of the materials secured to one another by added metal parts, mechanically able to withstand annealing operations at 600° C. This is indeed the maximum nanocrystallization temperature that it will be necessary, preferably at the end of this step, to apply to the formed transformer core assembly, when the materials of the windings 3, 4, 13 require it. If resins or glues are used beforehand to immobilize the wound magnetic strips relative to one another, they will then in all likelihood be deteriorated during the nanocrystallization annealing. Their use must therefore preferably be postponed until a step after the nanocrystallization annealing.

For reasons related to preserving the magnetic flux, it is preferable to wind, in this step, a material section 13, denoted $S_{13}$, approximately identical to each of the sections $S_3$ or $S_4$ that were wound and made from a material with low magnetostriction in the inner sub-cores. It is also preferable to minimize the empty zones situated between the three windings of material with low magnetostriction. Recommended $S_3/S_{13}$ or $S_4/S_{13}$ ratios will assume a value of 0.8 to 1.2 to offset the difference in winding perimeter and any air gap differences between the different materials that will be discussed later.

The structure next includes a new superimposed winding 14 (within the meaning seen above regarding inner magnetic sub-cores) around this part 13 with low magnetic losses and low magnetostriction of the outer magnetic sub-core. This new winding 14, the section of which will be denoted $S_{14}$, is formed from a strip of high Js and low-loss material, such as G.O. Fe-3% Si, Fe-6.5% Si, Fe-15 to 55% (Co, V, Ta, Cr, Si, Al, Mn, Mo, Ni, W) alloys, textured or not, soft iron and various steels, ferritic stainless steels Fe—Cr with 5 to 22% Cr, 0 to 10% total Mo, Mn, Nb, Si, Al, V and with more than 60% Fe, N.O. (non-oriented) electric steels Fe—Si—Al, Fe—Ni alloys close to 50% Ni, Iron-based magnetic amorphous materials. This final winding 14 completes the contribution of magnetic material in what makes up the wound yoke of the transformer.

It is preferable in this step to wind a section $S_{14}$ of material 14 with a high Js and low losses not too different from those of $S_1$ or $S_2$, which themselves are close or identical to one another, and which have been wound from a material 1, 2 with a high Js in the inner sub-cores, in order to have the same inrush attenuating effect in the three phases of the transformer. We will take $0.3 \leq S_{14}/S_1 \approx S_{14}/S_2 \leq 3$, since the material of the winding 14 with a high Js and low losses has a winding journey (perimeter) able to be very different from that of the material of the windings 1 or 2 placed at the center of the subassemblies, and this must be taken into account in dimensioning the composite core (this results from the application of the Ampere theorem).

Thus, the parts 3, 4 and 13 with low magnetic losses and low magnetostriction will have identical sections, or with the same order of magnitude, while the sections of materials with a high Js and low losses of the first windings of the two sub-cores 1 and 2 on the one hand, and the final winding 14 on the other hand, can be fairly significantly different within the specified limits.

The heat treatment for nanocrystallization of the windings 3, 4, 13 with low magnetic losses and low magnetostriction, if necessary, can be done at the end of this step, the set of metal materials having been assembled. However, due to the contraction of the material 3, 4, 13 during the nanocrystallization, after annealing, the second winding 14 of the outer sub-core may separate relative to the first winding 13 of the outer sub-core 13, making the "securing" of the assembly before cutting much more difficult. It is therefore preferable to apply this annealing at the end of the previous step, as previously stated.

At the end of this step for placement of the winding 14 with low magnetic losses and low magnetostriction of the outer sub-core, is, however, recommended to apply, by deposition or by prior gluing of the strips, or by vacuum impregnation (or any other appropriate method), a resin, glue, polymer, or other comparable substance, which will transform the wound magnetic yoke assembly into a strong single-piece body with high dimensional stability under stress. Hooping may potentially replace this gluing or impregnation, or precede it.

The magnetic yoke thus formed is then cut so as to divide the different sub-cores into two parts 15, 16 in order to form two elementary "half-circuits", after using different techniques for immobilizing the strips of material and sub-cores cited above. These two parts 15, 16 are intended to be separated by an air gap 17, as shown in FIG. 1. The cutting must be done while solidly maintaining the magnetic yoke, within the limit of the mechanical strength of the solidified core, and using any cutting method such as wire abrasion, crosscutting, water jet, laser, etc. It is preferable to divide the yoke into two symmetrical parts, as shown, but an asymmetry would not be contrary to the invention.

Working and surfacing of the future surfaces of the air gap 17 are then done, after which the two cut parts 15, 16 of the magnetic yoke are replaced across from one another (to return to the initial structure) after any shimming of the air gap 17, and after inserting primary 7, 8, 9 and secondary 10, 11, 12 premade windings of the transformer.

The air gap 17 serves to naturally demagnetize any part of the magnetic core at the moment of the electrical period where the magnetic excitation becomes low or nonexistent. Thus, if the transformer is initially stopped and, therefore, the magnetic yoke is demagnetized by the air gap ($B_r$=0), the inrush effect that one observes when the transformer is abruptly restarted will be reduced.

The surfacing or calibration of the air gap 17 are not absolutely necessary to the invention, but they allow a better adjustment of the performance of the transformer. This makes it possible to increase the inrush performance, and to make the characteristics of the transformers of a production series more reproducible.

The "replacement" or "assembly" of the two cut parts 15, 16 of the magnetic circuit, which are optionally surfaced and shimmed, can in particular be done using gripping by hooping also using a high Js material having properties comparable to those of the materials used in the winding 14, and therefore also participating (but without an air gap) in attenuating the inrush effect, like the other high Js materials. This option is particularly interesting, since it makes it possible to further lighten the magnetic circuit, while giving it a strong mechanical cohesion.

The high Js material section compared to the total section, on the one hand, for each sub-core considered alone, and on the other hand, for the magnetic core as a whole, is equal to 2 to 50%, and preferably 4 to 40%. Therefore, this section is most generally the minority, and in any case not the majority, in the elementary module outwardly defined by the winding 14 of the strip of high Js material superimposed on the winding 13 of the strip with a low magnetostriction and in each of the elementary modules of the inner sub-core.

In other words, the ratio of the winding sections between the high J2 materials ($S_1$, $S_2$, $S_{14}$) and materials with a magnetostriction λ ($S_3$, $S_4$, $S_{13}$) must be kept, for each elementary module, in a determined range so that the invention is implemented in a satisfactory manner. The proportion of high Js material (in terms of section ratios), relative to the total sections of both types of material, must be comprised between 2 and 50%, and preferably between 4 and 40%. This can be reflected by the following inequalities:

$$2 \le \frac{100 \cdot S_1}{S_1 + S_3} \le 50, \text{ preferably } 4 \le \frac{100 \cdot S_1}{S_1 + S_3} \le 40$$

$$2 \le \frac{100 \cdot S_2}{S_2 + S_4} \le 50, \text{ preferably } 4 \le \frac{100 \cdot S_2}{S_2 + S_4} \le 40$$

$$2 \le \frac{100 \cdot S_{14}}{S_{13} + S_{14}} \le 50, \text{ preferably } 4 \le \frac{100 \cdot S_{14}}{S_{13} + S_{14}} \le 40$$

$$\text{And also } 2 \le \frac{100 \cdot (S_3 + S_4 + S_{14})}{S_1 + S_2 + S_{13} + S_3 + S_4 + S_{14}} \le 50, \text{ preferably}$$

$$4 \le \frac{100 \cdot (S_3 + S_4 + S_{14})}{S_1 + S_2 + S_{13} + S_3 + S_4 + S_{14}} \le 40$$

To obtain proper operation of the transformer, by way of good balance of the masses of the different materials between the different magnetic circuits, and so as not to make it too heavy while benefiting from the advantages of the invention procured by the presence of the high Js material and all of the sub-cores, it is therefore necessary to respect the proportion in terms of section of high Js material of 2 to 50%, better still 2 to 40%, both for the transformer core as a whole, which reflects the latter inequality, and for each of its subassemblies (the two inner sub-cores (1, 2; 3, 4) and the outer sub-core (13, 14)) considered alone, which reflect the first three inequalities.

The different elements of the transformer normally all having the same depth p, these section ratios are equivalent to volume ratios of the different materials.

In order for the invention to be able to operate as required, it is necessary to be able to form a winding "mandrel" 1, 2, made from a high Js material for the material with a low magnetostriction 3, 4, and therefore a minimum amount of high Js material is necessary. The contribution to damping the inrush effect also requires a minimum section of high Js material. These two reasons, the minimum value of the section of high Js material relative to the total section of material, for each of the sub-cores and for the core as a whole, is set at 2%, preferably 4%.

If the high Js material becomes the majority in terms of section in the sub-cores and/or the core (≥50%), then its mass needlessly makes the structure heavier. As previously stated, it significantly actively participates only in damping the inrush effect, whereas in the steady state of the transformer, the high Js material should only become slightly magnetized so as not to emit noise (it inevitably has a medium to high apparent magnetostriction). Thus, the dimensioning of the transformer to achieve the desired power is essentially based on the material with a low magnetostriction λ. If there was less than 50% material with a low 2. (50% or more high Js material), there would essentially only be this minority structure that would participate in the electrical transformation. Consequently, the high Js material is limited to a maximum of 50% of the total section of magnetic materials present in the sub-cores and the core of the transformer, as stated above.

The following examples, which will be outlined later in table 4, and the comments related thereto, illustrate this point well:

For example, taking Fe49Co49V2 as the high Js material:

If one uses 100% Fe49Co49V2 (examples 2 to 5) to form the core of the transformer, it is necessary to lower $B_t$ (work induction of the transformer in the steady state) to less than 0.3 T to obtain a noise of 55-60 dB (whereas it will be seen that a noise of no more than 55 dB is desirable), which corresponds to a mass of more than 18.7 kg to be able to transform the requested electric power; in this example, the mass power density of the transformer core can be evaluated at a rate of 46 kVA/18.7 kg=2.46 kVA/kg of magnetic core, which is an excessively low power density to be acceptable;

In example 21 with 53.3% Fe49Co49V2 section (therefore 46.7% nanocrystalline material section), the noise (58 dB) is still too high to be compliant with the specifications; the total mass is 6.4 kg, or 28% larger than that of example 12, which is fully nanocrystalline, which would be acceptable, and the inrush index is −0.35, which is good;

Examples 19 and 20 show that an acceptable noise can be obtained with more than 50% Fe49Co49V2, but with an excessive total mass, which is respectively 7.4 and 7.1 kg (therefore 40 to 50% higher than with the nanocrystalline alone solution of example 12);

Unlike examples 18 and 18B, with 23.6 and 39% FeCo27 section, respectively, the noise is slightly too loud (56 and 58 dB), while the masses have been reduced to a suitable level; thus, having less than 50% of the magnetic section made from a high Js material is a necessary condition, but is not sufficient for satisfactory implementation of the invention; for example, examples 15 and 18C with 23.6 and 39% FeCo27 section, respectively, emit a low enough noise, for low masses of 5.1 and 5.8 kg, respectively, or only 2 and 16% section more than the nanocrystalline alone solution of example 12, but while making it possible to benefit from all of the advantages of the invention.

The elementary half-circuits formed by the parts 15, 16 are dimensionally very stable, in particular after impregnation with a varnish and polymerization, even under the maintaining stresses of the two C-shaped parts of the elementary magnetic core. This would not be the case if the high Js parts 1, 2 were removed that serve as mechanical supports for the windings 3, 4 with low magnetostriction, and stiffen each elementary core.

The magnetic alloys with low magnetostriction and low magnetic losses of the windings 3, 4 make it possible to satisfy most of the necessary requirements, in particular the very low acoustic noise emitted, even when a work induction $B_t$ close to saturation is used. This makes it possible, in this case, to maximize the power density, in particular in the case of nanocrystalline materials, where it is possible to work up to 1.2 T. It is the other material, with a high Js, of the outermost winding 14 of the core that contributes the most to damping the inrush effect.

However, it has surprisingly been noted that owing to the high Js magnetic support material of the inner windings 1, 2 of the sub-cores, the inrush effect is distributed over both types of material. Thus, the operating induction of the mainly nanocrystalline material can be increased almost up to saturation, which allows the transformer to be lightened accordingly.

The high Js alloys are characterized by a medium (FeSi, FeNi, iron-based amorphous materials) to high (FeCo) amplitude magnetostriction, which requires a very substantial decrease of the work induction $B_t$ (typically to no more than 0.7 T) to obtain a low acoustic noise.

It was realized that by jointly and wisely using alloys with low magnetostriction and low magnetic losses and high Js alloys, in particular, preferably, by the differentiated adjustment between the air gap 17 that is arranged, advantageously but not necessarily, between the materials of each pair of Cs, so as to give it a value ε1 at the first material and a value ε2 at the second material, and also by the respective proportions of the materials, it was possible at the same time to set a high work induction in the part with low magnetostriction on the one hand, and to set a low work induction in the high Js part on the other hand. By proceeding in this way, the inrush effect is sufficiently damped and distributed over the two types of material, and the noise emitted by each of the materials remains low, while allowing a fairly high power density, in all cases better than what is known in the state of the art for solutions in which a low magnetostriction noise is sought as a priority.

We will now describe example applications of the invention and reference examples, based on FIGS. 1 and 2 and on the experimental results of table 4, which reflects FIG. 3.

FIG. 2 considers a single-phase transformer core 18, characterized by an oblong rectangular shape with height h, width I and depth p, on which the winding of the main active material of the transformer bears: the material with low magnetostriction. This elementary core 18 can also be integrated into a three-phase transformer circuit, as shown in FIG. 1, as elementary module.

This single-phase transformer module with an oblong circuit is made with a first high Js material, with winding thickness ep1, and with a second material with low magnetostriction wound around the first material, in turn previously wound, and having a winding thickness ep2. The small and large inner sides of the winding 3 (second material), which are also the small and large outer sides of the winding 1 (first material) when it is present (like in the examples according to the invention and in certain reference examples), are respectively denoted "a" and "c", and are respectively equal, for all of the tested examples, to a=50 mm and c=125 mm. a and c are also the dimensions of the inner sides of the windings 3, 4 of the second material, with low magnetostriction, positioned around the windings 1, 2 of the high Js material. For all of the tests, ep2 is equal to 20 mm and ep1 is comprised, depending on the tests, between 0 (absence of high Js material) and 20 mm.

The depth p varies depending on the tests, since it is designed so that the transferred power is substantially the same in all of the tests (around 46 kVA), given that the values a and c are also the same in all of the tests. Note will be made (see table 4) that p can reach values as high as 265 mm for reference test 4 using a Fe49Co49V2 alloy alone and 176 mm for reference test 8 using a FeSi3 alloy alone. The reference solutions using a nanocrystalline alone and the solutions according to the invention that use a nanocrystalline and a high Js material have a significantly smaller depth p. In the examples according to the invention, it is approximately 60 to 80 mm.

The transformer is supplied with electrical current having a nominal frequency of 360 Hz. The primary power supply current has an intensity of 115 A with a number of turns $N_1$ generally equal to 1 turn, but being 5 turns in reference example 1 and 2 turns in reference examples 2, 3 and 4, in light of the considered air gaps of each winding 1 and 2 on the one hand, 3 and 4 on the other hand, and also in light of the considered material for each winding (therefore its permeability), in order to achieve the work induction $B_t$. A voltage of 230 V is applied to the primary. The secondary winding has, in all of the described examples, a number $N_2$=64 turns, and the expected nominal voltage at the secondary is 230 V. In all cases, the energy conversion system in which the transformer is integrated requires the latter to provide a constant voltage variation $V_1$ of 230 V. This also amounts to supplying a constant three-phase power of 46 kVA.

The magnetic core is therefore made from a wound structure of strips made up of:

- a first material with a high saturation;
- and, additionally, a second material with a low magnetostriction, wound around the first material.

In order always to deliver the same secondary voltage of 230 V, one plays on the section of the magnetic core, via the depth p of the core, while the wound thickness ep2 of the second material is kept identical for all of the tests, equal to 20 mm, and corresponds to a constant magnetic circuit length of 430 mm. Conversely, the magnetic circuit length of the first material, with a variable thickness depending on the examples, ranges from 270 to 343 mm in all of the examples according to the invention and in all of the reference examples with a dual-material elementary module. If P is considered to be the converted power, since P=I.fem (intensity of the primary current multiplied by the electromotive force fem generated at the secondary) is a sizing constraint (P=constant), and the electromagnetic force is imposed by the electrical circuit and since "fem=$N_2 \cdot B_t$·section of the core·2π·frequency", it is then necessary to increase the section when it is necessary to reduce $B_t$ in order to decrease the noise.

It will be recalled that it is the second material with low magnetostriction that works very primarily in the steady state, and therefore ensures the voltage and output power of the transformer. Conversely, the inrush effect comes from the combination of the magnetic behaviors of the two materials, and in order to assess the innovative contribution of the presence of another magnetic material (the first material) in the core, the wound thickness ep1 of this first material varies from 0 (which corresponds to an absence of the first material) to 20 mm depending on the tests. This corresponds to a magnetic circuit length varying from 0 to 343.2 mm.

The noise comes from the magnetostriction of the materials and their magnetization level, and the noise will therefore primarily be related in the steady state to the magnetic behavior of the second material. The inrush index is given by the known formula: $I_n=2 \cdot B_t+B_r-B_s$ for a magnetic core with a single magnetic material. This formula is generalized to the case of two materials according to:

$$(S_1+S_2) \cdot I_n = S_2 \cdot B_{r,2} + S_1 \cdot (2B_{t,1} - J_{s,1}) + S_2 \cdot (2B_{t,2} - J_{s,2})$$

where $S_1$ and $S_2$ are the sections of the windings of the first and second materials, respectively, $B_{r,2}$ is the remanent induction of the second material, alone active at the end of the steady state period when the shutoff of the transformer and the passage of the magnetic core to the remanent state occurs, $B_{t,1}$ and $B_{t,2}$ are the work inductions, $J_{s,1}$ and $J_{s,2}$ are the saturation magnetizations of the first and second materials, respectively. The formula can easily be adapted to the case where more than two materials are used.

dϕ/dt refers to the voltage induced (in other words, the electromotive force fem) by the transformer. It is used to convert the requested electrical power P: P=fem.I, where I is the intensity of the magnetizing current of the transformer.

The noise emitted by the different produced examples of wound transformer cores is measured by a set of microphones positioned around the transformer, in the median plane of the magnetic yoke. The different examples of magnetic cores use a single (references) or two (certain references and the invention) material(s), namely soft magnetic materials (FeCo27, Fe49Co49V2, Fe-3% Si-G.O., oriented-grain electric steel FeSi, FeCuNbSiB nanocrystalline of type $[Fe_{1-a}Ni_a]_{100-x-y-z-\alpha-\beta-\gamma}Cu_xSi_yB_zNb\alpha M'\beta M''\gamma$ with a=0; x=1; y=15; z=7.5; a=3; P=y=0. The material(s) is (are) wound according to the basic structure previously defined.

The examples of table 4 below are dimensioned and powered so as always to transfer substantially the same power, i.e., about 46 kVA. This three-phase power is given by $\sqrt{3}\cdot I_1\cdot d\phi/dt$ with $d\phi/dt=N_2\cdot(B_{t,1}\cdot S_1+B_{t,2}\cdot S_2)\cdot\omega=230V$, where $I_1=115$ A, $N_2$ (number of turns of the secondary) equal to 64, ω (pulsation)=2·π·f, f being the frequency, here equal to 360 Hz, $S_1$ and $S_2$ (magnetic yoke sections of the first and second materials, respectively) respectively equal to (H·ep1) and (H·ep2), and $B_{t,i}$ is the work induction of material i.

Another possibility consists of precisely adjusting the air gaps (after cutting) ε1 and ε2 between the half-circuits of the windings of the first and second materials, respectively, giving them, if applicable, different values during the working of the cut zones, so as to be able to limit the magnetization of one material relative to the other. Otherwise, certain uncontrolled magnetization levels of material 1 could increase the magnetostriction or the inrush effect far too much. It is, however, necessary to remember that increasing an air gap increases the current necessary for the magnetization at $B_t$, and therefore downgrades the performance of the transformer. A balance must therefore be found between the advantages and drawbacks of the practical use of the solution.

For example, in example 13 of the invention, the minimal residual air gap ε2 between the two half-circuits of the second material (the nanocrystalline material) is evaluated at 10 μm, and the equivalent relative magnetic permeability $\mu_{r,eq,mat2}$ of the "material 2+air gap" magnetic circuit causes the intrinsic permeability $\mu_{r,mat2}$ of material 2 to go from 30,000 to 17,670 in the case of the example (by applying formula $$\frac{1}{\mu_{r,eq,mat2}} \approx entrefer + \frac{1}{\mu_{r,mat2}}\Big).$$

If the air gap ε2 have been ten times wider (100 μm), there would have been an intrinsic permeability $\mu_{r,eq,mat2}=3760$, or four times lower than before. Yet (according to the Ampere theorem), $H\cdot L=N_1\cdot I$ (L being the average length of the magnetic circuit) and $H=B/\mu_{r,eq}$ as long as the material works with an approximately linear curve B=f(H) (case of the transformer). Therefore, by keeping $B_t$ constant (to keep the electromagnetic force and the transferred power constant, as previously stated), it is necessary to offset an increase of the air gap (and therefore a decrease of $\mu_{r,eq}$) with an increase of the intensity I of the magnetizing current, which causes a deterioration of the performance of the transformer.

If, in the same example 13, we consider the air gap ε1 of the magnetic circuits with a high Js material, we conclude that an air gap ε1 of 3.5 mm makes it possible to limit the equivalent permeability of the first material (here FeCo) to 0.05 T (see formula $\mu_{r,eq}$ above), and therefore a noise of 43 dB. If the air gap ε1 is decreased to 10 μm, therefore to a value equal to that of ε2, then the high Js material FeCo greatly exceeds the induction of 1 T in the steady state of the transformer, and the noise of the FeCo then becomes predominant and unsatisfactory (significantly greater than 55 dB), but may be acceptable during the duration of the inrush effect (i.e., from several fractions of a second to several seconds).

The general rule of limiting the inrush effects and noise is that, since the work induction $B_t$ has a deteriorating influence both on the inrush effect and on the magnetostriction noise, it is necessary to decrease $B_t$ to attenuate these effects. However, this decrease of $B_t$ must be offset by an increase in the magnetic section to keep dϕ/dt and the transformed power at the same level.

The specifications for this aeronautic transformer state that the noise must be no more than 55 dB, at least outside periods during which the inrush effect is felt, and the inrush factor must be less than or equal to 1, with the lowest possible mass of the magnetic core. Furthermore, the total mass of magnetic materials must not exceed about 6.5 kg. One will see that for this last condition to be met at the same time as the other two, the total section of high Js material relative to the total section of magnetic materials in the core must not exceed 50%. This condition must also be respected if we reason on each of the inner and outer sub-cores considered alone. To avoid making table 4 overly complicated, we have simply specified the ratio of the total sections therein, but it must be understood that all of the examples according to the invention also respect the condition for each of their sub-cores.

The examples of table 4 show the following. Those denoted "ref" are reference examples, and those denoted "inv" are examples according to the invention.

Examples 1 to 12, 18, 18B, 19 to 21, inclusively, of table 4 are therefore reference examples, and examples 13 to 17, inclusively, 18C, 22 to 24, inclusively, are examples according to the invention that satisfy all of the criteria of the specifications as previously defined.

It will be noted that for the reference examples 1 to 12, no air gap has been provided in the second material. For all of the other examples, whether they are reference examples or examples according to the invention, an air gap ε2 of 10 μm has been provided in the second material. For examples 13 to 24, whether they are reference examples or examples according to the invention, both an air gap ε2 of 10 μm in the second material and an air gap ε1 in the first material have been provided, ε1 being able to assume various values depending on the tests, and ε1 being different from ε2, except for example 24, where ε1=ε2=10 μm. It must be understood that in these examples, ε1 and ε2 are the same for all of the elements of the core: the two inner sub-cores and the outer sub-core.

To calculate the volumes and deduce the sections of the different materials therefrom, we have used densities of 7900 kg/m$^3$ for the FeCo27, 8200 kg/m$^3$ for the FeCo50V2, 7650 kg/m$^3$ for the FeSi3, 7350 kg/m$^3$ for the nanocrystalline.

The Js of the various materials are 2.00 T for the FeCo27, 2.35 T for the FeCo50V2, 2.03 T for the FeSi3, 1.25 T for the nanocrystalline.

TABLE 4

Performance of the different tested core configurations

| | | | | | Second material | | First material | | | | Mass and cross section | | | | | | | |
|---|---|---|---|---|---|---|---|---|---|---|---|---|---|---|---|---|---|---|
| Ex. | Materials 2 + 1 | ep 1 mm | ep 2 mm | p mm | $B_t$ material 2 $B_{t,2}$ (T) | Br material 2 Br (T) | $B_t$ material 1 $B_{t,1}$ (T) | Steady state dϕ/dt (V) | Noise (dB) | Inrush index | Mass material 1 (kg) | Mass material 2 (kg) | Total mass (kg) | wt % material 1 (with high Js) | % cross-section of material 1 (with high Js) | Three-phase power (kVA) | Air gap material 2 ε2 (μm) | Air gap material 1 ε1 (μm) |
| 1 ref | FeCo27 | 20 | 0 | 40 | 2 | 0.95 | — | 231.62 | 105 | 2.95 | 0 | 2.7 | 2.7 | 0 | 0 | 46.14 | 0 | 0 |
| 2 ref | Fe49Co49V2 | 20 | 0 | 40 | 2 | 1.3 | — | 231.62 | 115 | 2.95 | 0 | 2.8 | 2.8 | 0 | 0 | 46.14 | 0 | 0 |
| 3 ref | Fe49Co49V2 | 20 | 0 | 53 | 1.5 | 0.975 | — | 230.18 | 96 | 1.63 | 0 | 3.7 | 3.7 | 0 | 0 | 45.85 | 0 | 0 |
| 4 ref | Fe49Co49V2 | 20 | 0 | 80 | 1 | 0.65 | — | 231.62 | 75 | 0.3 | 0 | 5.6 | 5.6 | 0 | 0 | 46.14 | 0 | 0 |
| 5 ref | Fe49Co49V2 | 20 | 0 | 265 | 0.3 | 0.195 | — | 230.16 | 61 | −1.56 | 0 | 18.7 | 18.7 | 0 | 0 | 45.85 | 0 | 0 |
| 6 ref | FeSi3 | 20 | 0 | 53 | 1.5 | 1.05 | — | 230.18 | 92 | 2.02 | 0 | 3.5 | 3.5 | 0 | 0 | 45.85 | 0 | 0 |
| 7 ref | FeSi3 | 20 | 0 | 72 | 1.1 | 0.77 | — | 229.31 | 85 | 0.94 | 0 | 4.7 | 4.7 | 0 | 0 | 45.67 | 0 | 0 |
| 8 ref | FeSi3 | 20 | 0 | 176 | 0.3 | 0.21 | — | 229.31 | 57 | −1.22 | 0 | 19.0 | 19.0 | 0 | 0 | 45.67 | 0 | 0 |
| 9 ref | FeSi3 | 20 | 0 | 72 | 1.1 | 0 | — | 229.31 | 85 | 0.17 | 0 | 4.7 | 4.7 | 0 | 0 | 45.67 | 10 | 0 |
| 10 ref | Nanocrystalline lying or cut cycle | 20 | 0 | 72.3 | 1.1 | 0.055 | — | 230.26 | 40 | 1.01 | 0 | 4.6 | 4.6 | 0 | 0 | 45.87 | 10 | 0 |
| 11 ref | Nanocrystalline lying or cut cycle | 20 | 0 | 94 | 0.85 | 0.0425 | — | 231.33 | 40 | 0.49 | 0 | 5.9 | 5.9 | 0 | 0 | 46.06 | 10 | 0 |
| 12 ref | Nanocrystalline lying or cut cycle | 20 | 0 | 79.5 | 1 | 0.05 | — | 230.18 | 41 | 0.8 | 0 | 5.0 | 5.0 | 0 | 0 | 45.85 | 10 | 0 |
| 13 inv | Nanocrystalline lying or cut cycle + Fe49Co49V2 | 20 | 2 | 72 | 1.10 | 0.06 | 0.05 | 230.35 | 43 | 0.71 | 0.40 | 4.6 | 5.0 | 8.0 | 10.8 | 45.88 | 10 | 3500 |
| 14 inv | Nanocrystalline lying or cut cycle + FeCo27 | 20 | 1.7 | 70 | 1.1 | 0.055 | 0.4 | 229.83 | 46 | 0.8 | 0.33 | 4.4 | 4.7 | 7.0 | 9.3 | 45.78 | 10 | 360 |
| 15 inv | Nanocrystalline lying or cut cycle + Fe49Co49V2 | 20 | 5 | 66.3 | 1.1 | 0.055 | 0.4 | 230.35 | 49 | 0.49 | 0.90 | 4.2 | 5.1 | 17.6 | 23.6 | 45.88 | 10 | 360 |
| 16 inv | Nanocrystalline lying or cut cycle + Fe49Co49V2 | 20 | 2.1 | 68.3 | 1.1 | 0.055 | 0.6 | 229.98 | 48 | 0.8 | 0.40 | 4.3 | 4.7 | 8.5 | 11.2 | 45.81 | 10 | 220 |
| 17 inv | Nanocrystalline lying or cut cycle + Fe49Co49V2 | 20 | 2.5 | 66.5 | 1.1 | 0.055 | 0.75 | 229.84 | 52 | 0.8 | 0.46 | 4.2 | 4.7 | 9.8 | 13.1 | 45.78 | 10 | 160 |
| 18 ref | Nanocrystalline lying or cut cycle + FeCo18 | 20 | 5 | 60 | 1.1 | 0.055 | 0.9 | 230.18 | 56 | 0.69 | 0.81 | 3.8 | 4.6 | 17.6 | 23.6 | 45.85 | 10 | 120 |
| 18B ref | Nanocrystalline lying or cut cycle + FeCo18 | 20 | 10 | 56.7 | 1.1 | 0.055 | 0.6 | 229.83 | 58 | 0.29 | 1.44 | 3.6 | 5.0 | 28.8 | 39 | 45.78 | 10 | 120 |
| 18C inv | Nanocrystalline lying or cut cycle + FeCo18 | 20 | 10 | 66 | 1.1 | 0.055 | 0.2 | 229.31 | 53 | 0.02 | 1.68 | 4.2 | 5.88 | 28.6 | 39 | 45.67 | 10 | 120 |

TABLE 4-continued

Performance of the different tested core configurations

| | | | | | Second material | | First material | | | | Mass and cross section | | | | | | | |
|---|---|---|---|---|---|---|---|---|---|---|---|---|---|---|---|---|---|---|
| Ex. | Materials 2 + 1 | ep 1 mm | ep 2 mm | p mm | $B_t$ material 2 $B_{t,2}$ (T) | Br material 2 Br (T) | $B_t$ material 1 $B_{t,1}$ (T) | Steady state dϕ/dt (V) | Noise (dB) | Inrush index | Mass material 1 (kg) | Mass material 2 (kg) | Total mass (kg) | wt % material 1 (with high Js) | % cross-section of material 1 (with high Js) | Three-phase power (kVA) | Air gap material 2 ε2 (μm) | Air gap material 1 ε1 (μm) |
| 19 ref | Nanocrystalline lying or cut cycle + Fe49Co49V2 | 20 | 20 | 69 | 1.1 | 0.055 | 0.05 | 229.74 | 53 | −0.62 | 3.06 | 4.4 | 7.4 | 41.4 | 57.8 | 45.76 | 10 | 3500 |
| 20 ref | Nanocrystalline lying or cut cycle + FeCo27 | 20 | 17 | 69.5 | 1.1 | 0.055 | 0.05 | 229.90 | 52 | -0.49 | 2.73 | 4.4 | 7.1 | 38.5 | 53.3 | 45.79 | 10 | 3500 |
| 21 ref | Nanocrystalline lying or cut cycle + FeCo27 | 20 | 17 | 69.5 | 1.1 | 0.055 | 0.2 | 229.90 | 58 | −0.35 | 2.46 | 4.0 | 6.4 | 38.4 | 53.3 | 45.78 | 10 | 800 |
| 22 inv | Nanocrystalline lying or cut cycle + FeSi3 | 20 | 5 | 71.5 | 1.1 | 0.055 | 0.05 | 230.30 | 47 | 0.42 | 0.90 | 4.5 | 5.4 | 16.7 | 23.6 | 45.87 | 10 | 3500 |
| 23 inv | Nanocrystalline lying or cut cycle + FeSi3 | 20 | 5 | 71.5 | 1.1 | 0.055 | 0.05 | 230.30 | 50 | 0.42 | 0.90 | 4.5 | 5.4 | 16.7 | 23.6 | 45.87 | 10 | 3500 |
| 24 inv | Nanocrystalline lying or cut cycle + FeSi3 | 20 | 5 | 59 | 1.1 | 0.055 | 1 | 230.61 | 52 | 0.8 | 0.74 | 3.7 | 4.5 | 16.4 | 23.6 | 45.93 | 10 | 10 |

A completely nanocrystalline circuit (reference examples 10 to 12) of course makes it possible to meet the requirements of the specifications in terms of noise and inrush, for a mass of the magnetic circuit alone that may be as low as 4.6 kg, which would be satisfactory at first glance. However, this mass does not include the non-magnetic supports of the magnetic circuit, which may for example be made from wood, Teflon or aluminum, and which can constitute a mass of several hundred grams.

The nanocrystalline alone solution necessarily requires using a temporary or permanent winding support. If it is permanent, it makes the mass of the nanocrystalline circuit heavier, as stated above.

In all cases (permanent or temporary support), this support must be made, whereas it does not in any case participate in the electrical operation of the transformer, unlike the cases relative to the invention. The cost of producing the support is therefore not monetized in the design of the transformer, unlike the cases relative to the invention. Examples 10 to 12 are therefore not considered to correspond fully to the specifications of the invention, and are classified as references.

To clarify this important point, a comparison may be made between reference example 12 (nanocrystalline alone) and example 17 according to the invention (nanocrystalline composite core narrow or cut cycle+FeCo27). These two examples have been chosen because they can be considered the highest performing for their respective technological choices, since they have a same inrush index. The emitted noise is lower for the 100% nanocrystalline solution (41 dB versus 52 dB for the nanocrystalline composite core with lying or cut cycle+FeCo27), but in both cases, the noise is below the acceptable threshold of 55 dB.

Example 12 uses a nanocrystalline material mass of 5.0 kg, to which it is necessary to add a minimum mass of 200 to 300 g of Teflon, aluminum or nonmagnetic stainless steel. We have considered both possible cases for this example: permanent support and nonpermanent support.

Table 5 cites the successive operations in these embodiments, and compares the orders of magnitude of the costs of each step (from +: inexpensive to +++: expensive; 0: step missing from the embodiment) of the solutions in the scenario of a functional subassembly of a toroid alone (single-phase transformer type):

TABLE 5

Comparison of the costs of solutions 12 (reference) and 17 (invention)

| Step No. | 100% nanocrystalline solution (no. 12), nonpermanent support | Cost of the step | 100% nanocrystalline solution (no. 12), permanent support | Cost of the step | Solution according to the invention (no. 20) | Cost of the step |
|---|---|---|---|---|---|---|
| 1 | Production of a magnetic core nonpermanent support | ++ | Production of a magnetic core permanent support | + | Production of a FeCo magnetic metal support | ++ |
| 2 | Winding of the amorphous strip on a removable metal support (sleeve) | + | Winding of the amorphous strip on a removable metal support (sleeve) | + | Winding of the nanocrystalline strip on the support, with a nanocrystalline contraction shim (about 1%) removed at the end of winding | + |
| 3 | Nanocrystallization annealing and contraction of the amorphous ribbon on the sleeve | + | Nanocrystallization annealing and contraction of the amorphous ribbon on the sleeve | + | Nanocrystallization annealing and contraction on the FeCo support | + |
| 4 | Removal of the nanocrystalline core from the sleeve | + | Removal of the nanocrystalline core from the sleeve | + | 0 | 0 |
| 5 | Nanocrystalline core placed on the nonpermanent support with minimal play | + | Nanocrystalline core placed on the permanent support with minimal play | + | 0 | 0 |
| 6 | Impregnation of the "core + support" assembly | ++ | Impregnation of the "core + support" assembly | ++ | Impregnation of the "core + support" assembly | ++ |
| 7 | Polymerization of the assembly | + | Polymerization of the assembly | + | Polymerization of the assembly | + |
| 8 | Removal of the non-adhering support | + | | | 0 | 0 |
| 9 | Cutting of the impregnated core alone into two equal Cs | ++ | Cutting of the impregnated core + support into two equal Cs | + | Cutting into two equal Cs | + |

TABLE 5-continued

| Comparison of the costs of solutions 12 (reference) and 17 (invention) | | | | | | |
|---|---|---|---|---|---|---|
| Step No. | 100% nanocrystalline solution (no. 12), nonpermanent support | Cost of the step | 100% nanocrystalline solution (no. 12), permanent support | Cost of the step | Solution according to the invention (no. 20) | Cost of the step |
| 10 | Surfacing of the cutting faces of the Cs | + | Surfacing of the cutting faces of the Cs | + | Surfacing of the cutting faces of the Cs | + |
| 11 | Mechanical assembly with adjusted air gap (possible shim) | +++ | Mechanical assembly with adjusted air gap (possible shim) | ++ | Mechanical assembly with adjusted air gap (possible shim) | ++ |

Table 5: Comparison of the costs of solutions 12 (reference) and 17 (invention) Table 5 shows that there are fewer operations in the case of the invention, and furthermore, some of the operations shared by the various solutions are less expensive in the case of the invention. Indeed, during the cutting and assembly of the C-shaped pieces made from 100% nanocrystalline material (example 12 with no permanent mechanical support), the absence of stiffening mechanical support ("without permanent support" case) requires maintaining the Cs carefully, therefore using appropriate gripping gauges so as not to deform and destroy the pieces.

In the case of reference example 12 with a permanent support, the precautions are the same as for the invention, but in this case, the final core is made heavier, and the cost of the support is added to each produced magnetic core.

In the case of example 17 according to the invention, the FeCo support constitutes a mechanical core avoiding irreversible mechanical deformations, and at the same time is used functionally on the electromagnetic and electric levels.

Ultimately, relative to the invention, the 100% nanocrystalline solution of the prior art (example 12) is slightly more expensive due to the large number of operations, and heavier due to the mass of the support (case of the permanent support), or (case of the nonpermanent support) has an equal or slightly higher mass, but in any case significantly more expensive to produce. Globally, it therefore is not a satisfactory solution to the problems that the invention seeks to resolve.

Returning to table 4, one sees that a primarily nanocrystalline circuit with an additional circuit made from Fe-27% Co alloy in certain limited proportions makes it possible to achieve equivalent mass performance levels, or even slightly better (final mass close to 4.5 kg in the best case), while also respecting the specifications in terms of inrush and noise, if it is compared to a 100% nanocrystalline solution with a nonpermanent support (see above). This dimensioning optimum corresponds, in the case of the examples according to the invention, to a proportion in cross-section of FeCo or FeSi from about 9 to 40%, and from about 7 to 29 wt %, relative to all of the magnetic materials of the core. This optimum is also valid in each of the sub-cores considered alone.

By further increasing the proportion of FeCo, and therefore making the magnetic circuit heavier (case with more than 30 wt % and more than 50 wt % in cross-section of FeCo, examples 19, 20 and 21), one sees that the inrush effect can be drastically reduced to a negative index. In this case, the magnetic circuit reaches a mass of about 7 kg (for a zero inrush index). This mass may, however, be considered a bit too high for this technical solution to be fully satisfactory, inasmuch as, moreover, the noise is only slightly below the acceptable maximum of 55 dB (examples 19 and 20) or is above this acceptable maximum (example 21). A mass of about 6.5 kg would generally be considered acceptable, but only if the noise and inrush conditions are also met. This explains why example 21 is not considered to fall under the invention.

The use of FeSi-O.G. (electric steel Fe-3% Si with Oriented Grains), replacing the FeCo, in the previous case, makes it possible to observe the same trend results as in the previous case, but making the magnetic circuit slightly heavier if one wishes to obtain a comparable inrush index.

The use, alone and with no localized air gap (i.e., with a non-cut magnetic circuit) and a high induction, of traditional materials for aeronautic on board transformers (FeCo27, Fe49Co49V2, FeSi3) leads to very low magnetic circuit masses (examples 1, 2, 3, 6), but also to very significant noise (92 to 115 dB), significantly above the acceptable limit of 55 dB, and to a very significant inrush effect (inrush index of 1.63 to 2.95) that will cause a deterioration of certain electronic components on the on board network. It should be noted that if the circuit was cut to obtain a localized air gap and a very low remanence Br, then the inrush effect would be much lower. However, the noise would remain as loud and the implementation cost would be much higher.

The use of these same crystalline materials alone, but with a significantly lower induction, makes it possible to significantly reduce the inrush effect and the noise (examples nos. 4, 5, 7, 8, 9) until approaching (noise) or reaching (inrush) the acceptable limits of the specifications. However, when this situation is obtained (examples nos. 5 and 8), the mass of the magnetic circuit is about 18-19 kg, or three times higher than those of the reference solutions based on nanocrystalline alone and with a high induction, or solutions according to the invention where the nanocrystalline is associated with FeCo or FeSi.

FIG. 3 summarizes the performance of various possible magnetic circuit solutions in an inrush index-noise diagram where the transformer masses corresponding to the various points are also specified.

The maximum noise value of 55 dB and maximum inrush index of 1 required by the aforementioned specifications are identified in dotted lines. The zone in which the examples are found that satisfy these point of the specifications and also have a ratio of the cross-section of high Js material to the total cross-section of magnetic materials of no more than 50%, and a ratio of cross-sections of high Js materials to the total cross-sections of the magnetic materials of each sub-core of no more than 50%, is surrounded by a box. This last point, which is also part of the specifications, further makes it possible to guarantee that the core of the transformer has a very reduced weight, of about 6.5 kg or less.

It clearly appears that the invention makes it possible, through the use of a nanocrystalline circuit combined with FeCo or FeSi, to comply with the noise and inrush effect limitations by using much lighter magnetic circuits than the solutions using traditional crystalline materials (comparable FeSi, FeCo) used alone. Regarding the solutions using a nanocrystalline alone, their performance, at equal mass, is fairly comparable to that of the invention in terms of noise and inrush index, but it was shown in table 5 that the cost of producing these solutions was substantially higher than that of the embodiments according to the invention.

The inrush index is always a strictly decreasing function of the mass of the magnetic yoke. However, this curve is nonlinear, and makes it possible, in the case of the analyzed example, to determine magnetic yoke solutions with a fairly low mass (4 to 6.5 kg) for an inrush index that is already very reduced. Differently, the noise depends not only on the mass, but also the choice of the material(s) used (via their magnetostrictive properties).

It thus clearly appears that the solutions according to the invention based on nanocrystalline associated with another material (in particular FeCo or FeSi) make it possible to associate a low mass (4 to 6.5 kg), a low noise and a low inrush index, and for as moderate as possible a manufacturing cost and complexity.

Alternatives of the invention can be considered.

It is possible to use several high Js materials in the same magnetic core, for example a Goss texture Fe-3% Si alloy in the inner winding of the inner sub-cores and a Fe-50% Co alloy in the outer winding of the outer sub-core.

It is possible to use several materials with a low magnetostriction in the same magnetic core, for example a FeCuNbSiB nanocrystalline alloy with the composition specified above, in the inner winding of the inner sub-cores and a cobalt-based amorphous material in the outer winding of the outer sub-core. It is preferable to use the same material for both inner sub-cores. It is preferable to keep the rule of conserving the magnetic flux "$J_S$.Section" between the three sub-parts affected by the materials with low magnetostriction.

According to the invention, the use of nanocrystalline materials is recommended relative to the use of other types of materials with low magnetostriction.

Indeed, the cited nanocrystalline materials with composition FeCuNbSiB, which make up favored, but nonexclusive examples of materials usable to carry out the invention, are known for making it possible to adjust their magnetostriction to 0 using an appropriate heat treatment, while their saturation magnetization remains relatively high (1.25 T), therefore favorable to not making the transformer excessively heavy (see the dimensioning principles previously recalled influencing $d\phi/dt$ and the inrush).

The invention is valid not only for a three-phase structure with two sub-cores placed side by side and interleaved in a third sub-core, but is also applicable to a simple single-phase transformer magnetic core, or any other interleaving of a larger number of magnetic sub-cores, for example the case of multi-phase transformers with more than three phases. One skilled in the art may adapt the design of the transformer according to the invention to the latter case without difficulty.

The cutting of the completed magnetic core, forming the air gap 17, so as to better fill the winding window and therefore reduce the mass/volume of the magnetic core, is not essential, but is very preferable both for the preceding reason, since the power density is increased, by optimal filling of the winding window, and to decrease the remanent induction of the magnetic circuit. One additional interest of the cutting is to be able, optionally, to differentiate between the air gaps ε1 and ε2 of the two materials, in order to better control the maximum magnetization level of the first high Js material with a high magnetostriction.

The adjustment of the air gap can therefore be different between materials with a low magnetostriction and high Js materials, as seen in most of the examples according to the invention in table 4 and as shown in FIGS. 1 and 2. If the magnetostriction is very low, the cyclic deformation of the materials will be very low, and the shim of the air gap will not spread and will only amplify the noise slightly. Conversely, for high Js, very magnetostrictive materials, even for low work inductions in a steady state (less than 0.8 T, or even less than 0.4 T), the vibrations may still be sufficient to generate noise exceeding the strongest requirements. In this case, it may be preferable to machine a small air gap, greater than that of the material with low magnetostriction, so that the high Js materials are not in contact with the shim, which makes it possible to reduce the noise emission.

If this is of interest, it is also possible to provide different values of ε1 and/or ε2 for the various parts of the core, in other words, for the air gaps (ε1, ε2) separating the two parts of the various windings (1, 2, 3, 4, 13, 14) not all to be identical between the inner magnetic sub-core and the outer magnetic sub-core.

The surfacing of the cutting faces of the magnetic core is not essential, but it is preferable, since it allows better dimensioning of the performance of the transformer. This makes it possible to increase the inrush performance, and to make the transformers more reproducible during industrial production.

The calibration of the air gap using a shim is not essential, but is preferable for precise adjustment of the remanent induction (in particular related to the inrush effect) and the maximum magnetization level accessible in each material, and to make the transformers more reproducible in industrial production.

The cutting symmetry of the magnetic core is not essential.

In case of non-cutting, it is not essential to glue, impregnate, fasten the different metal parts of the yoke, more rigidly and narrowly than allowed by the various tightened windings and/or the heat treatment(s).

The different materials do not necessarily have the same width. For example, three strips of FeCuNbSiB nanocrystalline amorphous material each with a width I can be wound around an inner sub-core pre-wound toroid made from FeSi or FeCo with width 3I. This has the advantage of providing a same mechanical winding support for the FeCuNbSiB strips that are above all easy to produce and use when their width is smaller than 20-25 mm, whereas the needs for the magnetic cores of on board transformers can greatly exceed such widths.

As an alternative to the preceding solution, it is also possible to stack different magnetic cores with same widths of material, ultimately also in order to obtain a wider macro-toroid before gluing, fastening, impregnating, mechanical shimming or the like, then cutting, surfacing, then mounting of the prefabricated windings.

All of the materials, or only some of them, can be wound in the amorphous or work hardened or partially crystallized state (depending on the case), or can be wound in the nanocrystalline (FeCuNbSiB), relaxed (iron- or cobalt-based amorphous materials) or crystallized (Fe-80% Ni, FeCo, FeSi, other polycrystalline materials) state.

The invention claimed is:

1. An elementary module of a magnetic core of an electrical transformer of the wound type, comprising:

a first (1; 2) and second (3; 4) superimposed winding, respectively made from a first and second material, said first material being a crystalline material with a saturation magnetization (Js) greater than or equal to 1.5 T and magnetic losses of less than 20 W/kg in sinusoidal waves with a frequency of 400 Hz, for a maximum inductance of 1 T, and said second material being a material with an apparent saturation magnetostriction ($\lambda_{sat}$) less than or equal to 5 ppm and magnetic losses of less than 20 W/kg in sinusoidal waves with a frequency of 400 Hz, for a maximum induction of 1 T, the cross-sections ($S_1$; $S_2$) of the first winding (1; 2) and ($S_3$; $S_4$) of the second winding (3; 4) being such that the ratio ($S_1/(S_1+S_3)$; $S_2/(S_2+S_4)$) of each cross-section of the first material with a high saturation magnetization (Js) compared to the cross-section of the set of the two materials of the elementary module is comprised between 2 and 50%.

2. The elementary module according to claim 1, wherein said first material is chosen from among Fe-3% Si alloys with oriented grains, Fe-6.5% Si alloys, Fe-15 to 55% total of Co, V, Ta, Cr, Si, Al, Mn, Mo, Ni, W alloys, textured or not, soft iron and ferrous alloys made up of at least 90% Fe and having Hc<500 A/m, ferritic stainless steels Fe—Cr with 5 to 22% Cr, 0 to 10% total Mo, Mn, Nb, Si, Al, V and with more than 60% Fe, non-oriented electric steels Fe—Si—Al, Fe—Ni alloys with 40 to 60% Ni with no more than 5% total additions of other elements, Fe-based magnetic amorphous materials with 5 to 25% total B, C, Si, P and more than 60% Fe, 0 to 20% Ni+Co and 0 to 10% other elements, all of these content levels being given in percentages by weight.

3. The elementary module according to claim 1, wherein said second material is chosen from among Fe-75 to 82% Ni-2 to 8% (Mo, Cu, Cr, V) alloys, cobalt-based amorphous alloys, and FeCuNbSiB nanocrystalline alloys.

4. The elementary module according to claim 3, wherein said second material is a nanocrystalline alloy with composition:

$$[Fe_{1-a}Ni_a]_{100-x-y-z-\alpha-\beta-\gamma}Cu_xSi_yB_zNb\alpha M'\beta M''\gamma$$

with $a \leq 0.3$; $0.3 \leq x \leq 3$; $3 \leq y \leq 17$, $5 \leq z \leq 20$, $0 \leq \alpha \leq 6$, $0 \leq \beta \leq 7$, $0 \leq \gamma \leq 8$, M' being at least one of the elements V, Cr, Al and Zn, M" being at least one of the elements C, Ge, P, Ga, Sb, In and Be.

5. The elementary module according to claim 1, further comprising an air gap (17) dividing it into two parts.

6. The elementary module according to claim 5, wherein the air gap ($\varepsilon$1) separating the two parts of the first windings (1; 2) is different from the air gap ($\varepsilon$2) separating the two parts of the second windings (3; 4).

7. The elementary module according to claim 5, wherein said two parts are symmetrical.

8. A single-phase electric transformer magnetic core, wherein it is made up of an elementary module according to claim 1.

9. A single-phase electric transformer, including a magnetic core and primary and secondary windings, wherein the magnetic core is of the type according to claim 1.

10. A three-phase electric transformer magnetic core, comprising an inner magnetic sub-core made up of two elementary modules according to claim 1, alongside one another; and an outer magnetic sub-core made up of two additional superimposed windings (13, 17), positioned in this order around the inner magnetic sub-core:

a first winding (13) made from a strip of the material with low magnetic losses of less than 20 W/kg in sinusoidal waves with a frequency of 400 Hz, for a maximum induction of 1 T and with a saturation apparent magnetostriction ($\lambda_{sat}$) less than or equal to 5 ppm;

a second winding (14) made from a strip of the material with a high saturation magnetization (Js) greater than or equal to 1.5 T and low magnetic losses of less than 20 W/kg in sinusoidal waves with a frequency of 400 Hz, for a maximum induction of 1 T;

the cross-section ($S_{13}$) of the first winding of the outer magnetic sub-core and the cross-section ($S_{14}$) of the second winding (14) of the outer magnetic sub-core being such that the ratio ($S_{14}/(S_{13}+S_{14})$) of the cross-section of the material with a high saturation magnetization and the cross-section of the set of the two materials of the outer magnetic sub-core is comprised between 2 and 50% and the cross-section of material with a high saturation magnetization (Js) in the assembly of the core, in terms of ratio of cross-sections, relative to the total cross-sections of the two types of materials in the assembly of the core $$\left(\frac{(S_3+S_4+S_{14})}{S_1+S_2+S_{13}+S_3+S_4+S_{14}}\right)$$

being comprised between 2 and 50%.

11. The three-phase electric transformer magnetic core according to claim 10, wherein said first winding (13) of the outer magnetic sub-core can be made from a material chosen from among Fe-75 to 82% Ni-2 to 8% (Mo, Cu, Cr, V) alloys, cobalt-based amorphous alloys, and FeCuNbSiB nanocrystalline alloys.

12. The three-phase electric transformer magnetic core according to claim 11, wherein said first winding (13) of the outer magnetic sub-core is made from a nanocrystalline material with composition:

$$[Fe_{1-a}Ni_a]_{100-x-y-z-\alpha-\beta-\gamma}Cu_xSi_yB_zNb\alpha M'\beta M''\gamma$$

with $a \leq 0.3$; $0.3 \leq x \leq 3$; $3 \leq y \leq 17$, $5 \leq z \leq 20$, $0 \leq \alpha \leq 6$, $0 \leq \beta \leq 7$, $0 \leq \gamma \leq 8$, M' being at least one of the elements V, Cr, Al and Zn, M" being at least one of the elements C, Ge, P, Ga, Sb, In and Be.

13. The three-phase electric transformer magnetic core according to claim 10, wherein said second winding (14) of the outer magnetic sub-core is made from a material chosen from among Fe-3% Si alloys with oriented grains, Fe-6.5% Si alloys, Fe-15 to 50% total of Co, V, Ta, Cr, Si, Al, Mn, Mo, Ni, W alloys, textured or not, soft iron and ferrous alloys made up of at least 90% Fe and having He<500 A/m, ferritic stainless steels Fe—Cr with 5 to 22% Cr, 0 to 10% total Mo, Mn, Nb, Si, Al, V and with more than 60% Fe, non-oriented electric steels Fe—Si—Al, Fe—Ni alloys with 40 to 60% Ni with no more than 5% total additions of other elements, Fe-based magnetic amorphous materials with 5 to 25% total B, C, Si, P and more than 60% Fe, 0 to 20% Ni+Co and 0 to 10% other elements.

14. The magnetic core according to claim 10, further comprising an air gap (17) dividing it into two parts.

15. The magnetic core according to claim 14, wherein the air gap (ε1) separating the two parts of the first windings (1; 2) of the inner magnetic sub-core and the two parts of the second winding (14) of the outer magnetic sub-core is different from the air gap (ε2) separating the two parts of the second windings (3; 4) of the inner magnetic sub-core and the two parts of the first winding (13) of the outer magnetic sub-core.

16. The magnetic core according to claim 14, wherein the various air gaps (ε1, ε2) separating the two parts of the various windings (1, 2, 3, 4, 13, 14) are not all identical between the inner magnetic sub-core and the outer magnetic sub-core.

17. The magnetic core according to claim 10, wherein the ratio between the cross-section ($S_{13}$) of the first winding (13) of the outer magnetic sub-core and the cross-section ($S_3$; $S_4$) of the second windings (3, 4) of the inner magnetic sub-core is comprised between 0.8 and 1.2.

18. The magnetic core according to claim 10, wherein the ratio between the cross-section ($S_{14}$) of the second winding (14) of the outer magnetic sub-core and the cross-section ($S_1$; $S_2$) of the first windings (1, 2) of the inner magnetic sub-core is comprised between 0.3 and 3.

19. The magnetic core according to claim 14, wherein said two parts are symmetrical.

20. A three-phase electric transformer, including a magnetic core and primary and secondary windings, wherein the magnetic core is of the type according to claim 10.

21. A method for manufacturing a single-phase electric transformer magnetic core according to claim 8, comprising the following steps:

manufacturing a magnetic metal support in the form of a first winding (1) made from a first material, said first material being a crystalline material with a high saturation magnetization (Js) greater than or equal to 1.5 T and low magnetic losses of less than 20 W/kg at a frequency of 400 Hz in sinusoidal waves, for a maximum induction of 1 T;

winding, on said metal support, a second winding (3) made from a material having, or being intended to have, after a nanocrystallization annealing, a saturation apparent magnetostriction ($\lambda_{sat}$) less than or equal to 5 ppm and magnetic losses less than 20 W/kg in sinusoidal waves with a frequency of 400 Hz, for a maximum induction of 1 T and 2 to 50% in proportion of cross-section of material with a high saturation magnetization;

optionally, performing a nanocrystallization and contraction annealing of said second winding (3) on said support; and securing the two windings (1, 3).

22. A method for manufacturing a three-phase electric transformer magnetic core according to claim 10, comprising the following steps:

producing an inner magnetic sub-core made up of two elementary modules, each elementary module being produced as follows:

manufacturing a magnetic metal support in the form of a first winding (1; 2) made from a first material, said first material being a crystalline material with a high saturation magnetization (Js) greater than or equal to 1.5 T and low magnetic losses of less than 20 W/kg in sinusoidal waves with a frequency of 400 Hz, for a maximum induction of 1 T;

winding, on said metal support, a second winding (3; 4) made from a material having, or being intended to have, after a nanocrystallization annealing, a saturation apparent magnetostriction ($\lambda_{sat}$) less than or equal to 5 ppm and magnetic losses less than 20 W/kg in sinusoidal waves with a frequency of 400 Hz, for a maximum induction of 1 T, the ratio of the cross-section of material with a high saturation magnetization (Js) to the total of the cross-sections of the materials of the first (1; 2) and second (3; 4) windings being from 2 to 50%;

optionally, performing a nanocrystallization and contraction annealing of said second winding (3; 4) on said support;

placing said elementary modules alongside one another along one of their sides, in order to form said inner magnetic sub-core;

producing an outer magnetic sub-core as follows:

positioning, around the inner magnetic sub-core, a third winding (13) made from a strip of material having, or being intended to have, after a nanocrystallization annealing, a saturation apparent magnetostriction ($\lambda_{sat}$) less than or equal to 5 ppm and magnetic losses less than 20 W/kg in sinusoidal waves with a frequency of 400 Hz, for a maximum induction of 1 T;

optionally, performing a nanocrystallization and contraction annealing of said third winding (13) on the inner magnetic sub-core;

positioning, around said third winding (13), a fourth winding (14) made from a material with a high saturation magnetization (Js) greater than or equal to 1.5 T and low magnetic losses of less than 20 W/kg in sinusoidal waves with a frequency of 400 Hz, for a maximum induction of 1 T, the ratio of the cross-section of material with a high saturation magnetization (Js) to the total of the cross-sections of the materials of the third (13) and fourth (14) windings being from 2 to 50% and the proportion of material with a high saturation magnetization (Js) in the entire core, in terms of ratios of cross-sections, relative to the total cross-sections of the two types of materials, being comprised between 2 and 50; and securing said windings (1, 2, 3, 4, 13, 14).

23. The method according to claim 21, wherein said magnetic transformer core is cut so as two form to elementary cores, said elementary cores next being intended to be reassembled so as to define an air gap between them (17).

24. The method according to claim 23, wherein the two elementary cores are symmetrical.

25. The method according to claim 23, wherein the surfaces of the elementary cores intended to define the air gap (17) are worked and surfaced before the elementary cores are reassembled.

26. The method according to claim 25, wherein (previously presented) that the surfaces intended to define the air gap (17) separating the first windings (1; 2) of the two elementary cores define an air gap (ε1) different from the air gap (ε2) separating the second windings (3; 4) of the two elementary cores.

27. The method according to claim 23, wherein the two elementary cores are reassembled by sintering using a crystalline material with a high saturation magnetization (Js) greater than or equal to 1.5 T and low magnetic losses of less than 20 W/kg in sinusoidal waves with a frequency of 400 Hz, for a maximum induction of 1 T.

28. The elementary module according to claim 1, wherein, the saturation magnetization (Js) of said first material is greater than or equal to 2.0 T and the magnetic losses of is less than 15 W/kg in sinusoidal waves with the frequency of 400 Hz, for the maximum inductance of 1 T, the apparent saturation magnetostriction ($\lambda_{sat}$) of said second material is less than or equal to 3 ppm and the magnetic losses of is less than 15 W/kg in sinusoidal waves with the frequency of 400 Hz, for the maximum inductance of 1 T, and the cross-sections ($S_1$; $S_2$) of the first winding (1; 2) and ($S_3$; $S_4$) of the second winding (3; 4) is such that the ratio ($S_1/(S_1+S_3)$; $S_2/(S_2+S_4)$) of each cross-section of the first material with the high saturation magnetization (Js) compared to the cross-section of the set of the two materials of the elementary module is comprised between 4 and 40%.

29. The elementary module according to claim 1, wherein, the saturation magnetization (Js) of said first material is greater than or equal to 2.2 T and the magnetic losses of is less than 10 W/kg in sinusoidal waves with the frequency of 400 Hz, for the maximum inductance of 1 T, the apparent saturation magnetostriction ($\lambda_{sat}$) of said second material is less than or equal to 1 ppm and the magnetic losses of is less than 10 W/kg in sinusoidal waves with the frequency of 400 Hz, for the maximum inductance of 1 T, and the cross-sections ($S_1$; $S_2$) of the first winding (1; 2) and ($S_3$; $S_4$) of the second winding (3; 4) is such that the ratio ($S_1/(S_1+S_3)$; $S_2/(S_2+S_4)$) of each cross-section of the first material with the high saturation magnetization (Js) compared to the cross-section of the set of the two materials of the elementary module is comprised between 4 and 40%.

30. The elementary module according to claim 1, wherein the cross-sections ($S_1$; $S_2$) of the first winding (1; 2) and ($S_3$; $S_4$) of the second winding (3; 4) is such that the ratio ($S_1/(S_1+S_3)$; $S_2/(S_2+S_4)$) of each cross-section of the first material with the high saturation magnetization (Js) compared to the cross-section of the set of the two materials of the elementary module is comprised between 4 and 40%.

* * * * *